United States Patent [19]

Kawahara et al.

[11] Patent Number: 5,022,172

[45] Date of Patent: Jun. 11, 1991

[54] DISPLAY APPARATUS FOR AN AUTOMATIC VENDING MACHINE

[75] Inventors: Tsugio Kawahara, Saitama; Hiromasa Harashima, Gunma; Shunji Ubukata, Gunma; Kazuo Kameda, Gunma; Hirohito Moriya; Yoshihisa Inamura, both of Saitama, all of Japan

[73] Assignee: Sanyo Electric Co., Ltd., Osaka, Japan

[21] Appl. No.: 169,893

[22] Filed: Mar. 18, 1988

[30] Foreign Application Priority Data

| | | | |
|---|---|---|---|
| Mar. 19, 1987 | [JP] | Japan | 62-64763 |
| Apr. 2, 1987 | [JP] | Japan | 62-82031 |
| Jun. 25, 1987 | [JP] | Japan | 62-159252 |
| Jun. 29, 1987 | [JP] | Japan | 62-161529 |

[51] Int. Cl.[5] ..... G09F 11/02

[52] U.S. Cl. ..... 40/503; 40/446; 40/475

[58] Field of Search ..... 40/466, 467, 463, 476, 40/493, 501-513, 475, 459, 460, 476, 492, 497

[56] References Cited

U.S. PATENT DOCUMENTS

| | | | |
|---|---|---|---|
| 1,765,073 | 6/1930 | Hester et al. | 40/505 |
| 2,655,242 | 10/1953 | Chalfin et al. | 40/466 |
| 3,277,595 | 10/1966 | Johnson | 40/470 X |
| 3,919,794 | 11/1975 | Hunter, Jr. | 40/502 |
| 4,168,587 | 9/1979 | Falk | 40/505 X |
| 4,639,875 | 1/1987 | Abraham et al. | 221/4 |
| 4,759,140 | 7/1988 | Roberts et al. | 40/503 |

FOREIGN PATENT DOCUMENTS

| | | |
|---|---|---|
| 61-33174 | 2/1986 | Japan . |
| 61-37578 | 3/1986 | Japan . |
| 61-55778 | 4/1986 | Japan . |

*Primary Examiner*—Richard J. Apley
*Assistant Examiner*—D. F. Crosby
*Attorney, Agent, or Firm*—Darby & Darby

[57] ABSTRACT

An automatic vending machine, or a slot machine, has a display plate provided at the rear wall of a sample room which is covered by a transparent window panel fitted in a front door of the machine. A plurality of vertically elongate display strips arranged side by side at desired intervals adjacent to the display plate to be rotatable about their own axes. The front or rear faces of these display strips can cooperate with each other to produce associated composite figures, which fully covers the display plate when the display strips rotate together at the same time whereby either the front or rear faces of the display strips take their positions substantially parallel to the display plate. Consequently, the composite display figures formed by the front and rear faces of the display strips can be seen from the front of the machine. Also, when the front or rear faces of the display strips take their positions substantially at right angles to the display plate, the graphic figure printed on the display plate can be seen from the front of the machine.

23 Claims, 18 Drawing Sheets

DISPLAY APPARATUS FOR AN AUTOMATIC VENDING MACHINE

FIELD OF THE INVENTION

The present invention relates to a display apparatus for an automatic vending machine or a slot machine. The display apparatus is adapted to generally show graphic displays, such as pictures and letters, on the front surface of the rear wall of a sample room for exhibiting the samples of articles of trade.

BACKGROUND OF THE INVENTION

An automatic vending machine is generally provided in the inside of a front door with a sample room for exhibiting the samples of articles of trade, the sample room being covered by a transparent window panel fitted in the front door. The sample room is provided on the rear wall thereof with a display plate on which a graphic display is printed. The graphic display is selected from such pictures and advertising words that are suitable for exciting consumers' interest.

Known display apparatus for an automatic vending machine have a single graphic display printed on a display plate, which is removably attached to the rear wall of the display apparatus to be exchangeable for another display plate, as disclosed in, for instance, Japanese Utility Model Publication Nos. A-55778/86, A-33174/86, and A-37578/86.

However, although these known display apparatus can be manufactured at low cost, when the graphic display is to be exchanged for another, doing so is troublesome, and it is actually hard to frequently carry out exchanging work.

To eliminate such a disadvantage, U.S. Pat. No. 2,680,316 suggests an apparatus comprising a plurality of vertically elongate display rods of the same size, each having a triangular cross-section, which rods are arranged side by side at desired intervals to be rotatable about their own vertical axes so that three side faces of the display rods can cooperate with each other to intermittently produce associated three different composite display figures when the display rods rotate together at the same time for every 120 degrees to have relevant side faces of the display rods aligned in a plane.

The display rod is usually made of plastics or aluminum, and the figures on the side faces of each display rod are formed by silk screen printing. Upon printing, relevant side faces of the rods must be positioned to be aligned with each other in completely the same level to be capable of forming a composite figure as a whole. For this purpose, a special device must be used to hold all the relevant side faces of the triangular rods collectively in the same level. Thus, it is hard to carry out the printing operation.

Furthermore, the distance of a space between the samples of articles of trade and the display rods is to be reduced because of the thickness of the triangular rod. Therefore, if the above-mentioned distance is to be increased to have a desired dimension, the depth of the body of the slot machine will also be increased. Also, if only a composite figure formed on an aligned surface consisting of the relevant side faces of the rods is to be exchanged with another, all the rods must be removed from the slot machine.

BRIEF SUMMARY OF THE INVENTION

A main object of the present invention is to provide a display apparatus in which a graphic display can be easily printed and exchanged for a new one.

A further object of the present invention is to enlarge the distance of a space between the samples of articles of trade and a graphic display, and accordingly, to make conservation and inspection operations ease, without the depth of the body of an automatic vending machine being increased.

According to the present invention, there is provided a display apparatus for an automatic vending machine comprising a sample room for exhibiting the samples of articles of trade which is covered by a transparent window panel fitted in a front door of the vending machine; a display plate having a display figure formed thereon, the plate being located on the rear wall of the sample room; a plurality of vertically elongate display strips, which are arranged side by side at desired intervals adjacent to the display plate to be rotatable about their own vertical axes so that either the front faces or the rear faces of the display strips can cooperate with each other to produce associated composite display figures, which fully covers the display figure of the display plate when the display strips rotate together at the same time whereby either the front or rear faces of the display strips take their positions substantially parallel to the display plate; driving means for rotating all the display strips at the same time about their own vertical axes; and control means for controlling the movement of the display strips to temporarily hold them in a position where each strip is substantially at right angles to the display plate, or in a position where either the front face, or the rear face, of each strip is substantially parallel to the display plate, whereby the display figure of the display plate, and the composite display figures to be produced by the front and rear faces of the display strips can intermittently be seen from the front of the machine at the prescribed time intervals.

Thus, the printing of graphic figures can readily be carried out on not only the display plate, but also the integrated front or rear faces of the plurality of display strips that form associated planes. Therefore, the printing in the present invention can more readily and accurately be carried out than that in the known triangular rods. Also, the graphic figures printed on both the display plate and the display strips can separately be exchanged for another, because either of them can independently be removed from the machine. Furthermore, as the display strips are located adjacent to the display plate, the distance between the samples of articles of trade and the display strips or the display plate, can be increased, whereby conservation and inspection operations and the exchange of parts can be readily carried out.

The present invention can be applied to an automatic vending machine comprising an upper and a lower sample rooms for exhibiting the samples of articles of trade, the two rooms being located on both sides of a service panel which is attached to a front door of said vending machine, each sample room being covered by a transparent window panel which is fitted in the front door. In this kinds of vending machines, the display apparatus comprises an upper and lower display plates, each having a display figure formed thereon, the plates being located on the rear walls of the upper and lower sample rooms, respectively; a plurality of vertically elongate display strips, each of which extends to both sample rooms, and which are arranged side by side at desired intervals adjacent to the upper and lower display plates to be rotatable about their own vertical axes so that either the front faces or the rear faces of the display strips can cooperate with each other to produce associated composite display figures, which fully cover the display figures of the display plates when the display strips rotate together at the same time whereby either the front faces or the rear faces of the display strips take their positions substantially parallel to the display plates; driving means for rotating all the display strips at the same time about their own vertical axes; and control means for controlling the movement of the display strips to temporarily hold them in a position where each strip is substantially at right angles to the display plates, or in a position where either the front face or the rear face of each strip is substantially parallel to the display plates, whereby the display figure of each of the upper and lower display plates, and the composite display figures to be produced by the front and rear faces of the display strips can intermittently be seen from the front of the machine at the prescribed time intervals.

The display strips in the present invention can be separated into groups, typically two groups, which are mechanically and operatively connected with each other to be moved at the same time by a single drive motor.

Thereupon, according to another aspect of the present invention, there is provided a display apparatus for an automatic vending machine comprising an upper and a lower sample rooms for exhibiting the samples of articles of trade, the two sample rooms being located on both sides of a service panel which is attached to a front door of the vending machine, each sample room being covered by a transparent window panel which is fitted in the front door, characterized by an upper display plate and a lower display plate, each plate having a display figure formed thereon, the plates being located on the rear walls of the upper and lower sample rooms, respectively; an upper group of a plurality of vertically elongate display strips and a lower group of a plurality of vertically elongate display strips, the display strips of the upper and lower groups being arranged side by side at desired intervals adjacent to the upper and lower display plates, respectively, to be rotatable about their own vertical axes so that either the front faces or the rear faces of the display strips can cooperate with each other to produce associated composite display figures, which fully cover the display figures of the display plates when the display strips of each group rotate together at the same time whereby either the front faces or the rear faces of the display strips of each group take their positions parallel to the associated display plates; driving means for rotating the upper group of the display strips and the lower group of the display strips at the same time about their own vertical axes; and control means for controlling the movement of each group of the display strips to temporarily hold them in a position where each strip is substantially at right angles to the associated display plates, or in a position where either the front face or the rear face of each strip is substantially parallel to the associated display plates, whereby the display figure of each of the upper and lower display plates, and the composite display figures to be produced by the front and rear faces of the display strips of each group can intermittently be seen from the front of the machine at the prescribed time intervals.

Preferably, each display strip is pivotally supported about a vertical axis at the rearward side thereof so that the length of the display strip can expand or contract. Consequently, the display strip can be prevented from being distorted by the change of temperature.

Also, it is preferable that the display apparatus of the present invention comprises detecting means adapted to be actuated in response to the opening of the front door of the body of the automatic vending machine, and the control means comprises means for stopping the movement of the display strips, in response to a signal given from the detecting means, to hold them in a position substantially parallel to the display plates. Consequently, upon opening the front door, the distance between the samples of articles of trade and the display strips can be increased, and therefore, conservation and inspection operations and the exchange of parts can be readily carried out.

Also, it is preferable that the driving means comprises a transversely elongate driving member with which a projection extending vertically from an end of the forward side of each display strip is freely rotatably connected; a pair of linkage members freely connected with the transversely elongate driving member at its opposite ends to allow it to reciprocate in its lengthwise directions; a swing arm connected with said driving member at its central part; and a drive motor connected with said swing arm through a reduction mechanism, whereby the display strips can be rotated together about their own vertical axes in a clockwise or anticlockwise directions by the drive motor. Also, the control means may preferably actuate the movement of the display strips in response to a signal base on a selling operation of the automatic vending machine, and furthermore, it is preferable that the signal is generated when any of article selection buttons is pushed, during the selling operation initiated by putting coins or a card in a coin slot or a card slot, respectively. Also, the signal may be generated when coins or a card is put in a coin slot or a card slot, respectively. Also, the signal may be generated when coins put in the coin slot reach the due amount of charges for selling the relevant articles of trade.

The control means preferably comprises means for stopping the movement of the display strips for a prescribed period after the end of each cycle in which the display strips return from a starting position of their movement to the starting position. Alternatively, the control means may comprise means for stopping the movement of the display strips for a prescribed period after the end of each cycle in which the display strips move from a starting position of their movement to a position where they temporarily stop just before the starting position. Furthermore, the control means preferably comprises mode changing means for interchanging a mode of stopping the movement of the display strips for a prescribed period after the end of each cycle, with a mode of continuing the movement of the display strip without intermission after the end of each cycle. Also, the control means may comprise means for selectively stopping the movement of each display strip for a prescribed period in a position where each strip is substantially at right angles to the display plate, or in a position where a face of each strip is substantially parallel to the display plate.

BRIEF DESCRIPTION OF THE DRAWINGS

FIG. 1 is a diagrammatic perspective view of the automatic vending machine.

FIG. 2 is a fragmentary side view, partly in cross-section, of a sample room of the machine.

FIG. 3 is an exploded perspective view of a display strip and a pair of support members attached to the upper and lower ends of the display strip.

FIG. 4 is a cross-sectional fragmentary view taken along the line A—A' of FIG. 2.

FIG. 5 is a perspective view of the display strips and driving means connected therewith.

FIG. 6 is an illustration of a switchboard on the outside surface of a control box, which is attached to the rear wall of a service panel provided in a front door of the machine.

FIG. 7 is control circuits housed in the control box.

FIGS. 8 to 10 are the illustrations of the graphic figures to be seen depending on the movement of the display strips.

FIG. 11 is a diagrammatic perspective view of the automatic vending machine.

FIG. 12 is a fragmentary side view, partly in cross-section, of two sample rooms of the machine.

FIG. 13 is an exploded fragmentary perspective view of the display strips, a display plate, and driving means to be connected therewith.

FIGS. 14 to 16 are the illustrations of the movement of the display strips.

FIG. 17 is a diagrammatic perspective view of the automatic vending machine.

FIG. 18 is a fragmentary side view, partly in cross-section, of two sample rooms of the machine.

FIG. 19 is an exploded fragmentary perspective view, partly in cross-section, of an upper group of display strips, a lower group of display strips, and driving means operatively connecting the upper group with the lower group.

FIG. 20 is a cross-sectional fragmentary view taken along the line B—B' of FIG. 18.

FIG. 21 is a perspective view of the display strips, a display plate, and driving means connected therewith.

FIG. 22 shows a positional relationship between a display plate, a control cam, and a control switch.

FIG. 23 is a cross-sectional fragmentary view taken along the line C—C' of FIG. 21.

DETAILED DESCRIPTION OF THE PREFERRED EMBODIMENTS

A first embodiment of the display apparatus of the present invention will be described with respect to FIGS. 1 to 10.

Figure 1:
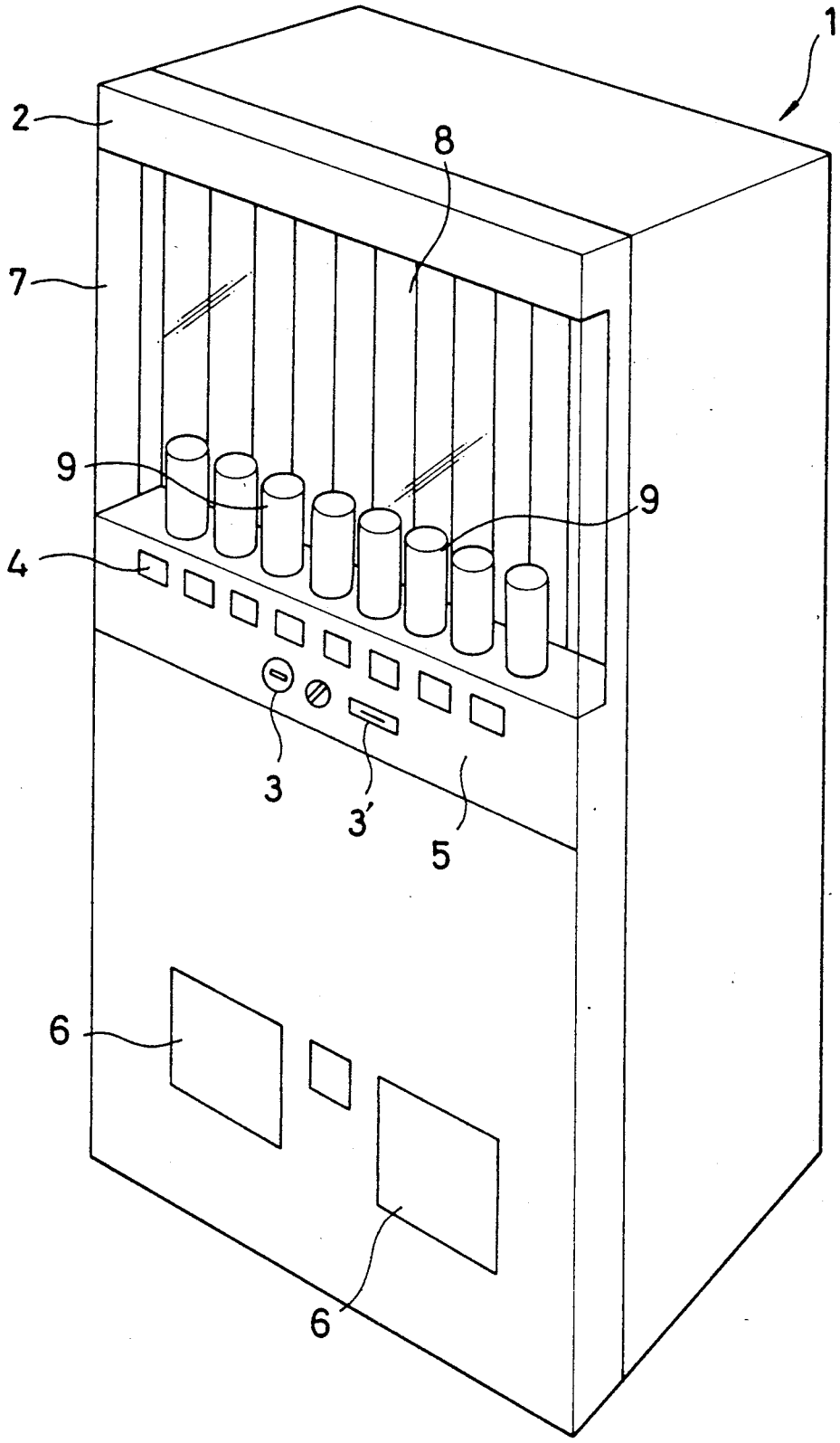
FIGS. 1 to 10 are drawings relating to a first embodiment of a display apparatus for an automatic vending machine or a slot machine according to the present invention.

As shown in FIG. 1, an automatic vending machine has a body 1 and a front door 2 hinged thereto. The door 2 has a service panel 5, which is provided with a coin slot 3, a card slot 3', and a plurality of article selection buttons 4, article delivery windows 6, and a sample room 8 for exhibiting the samples of articles of trade 9 which is covered by a transparent window panel 7. These article selection buttons 4 are positioned correspondingly to the samples 9, which are placed in the sample room 8.

Figure 2:
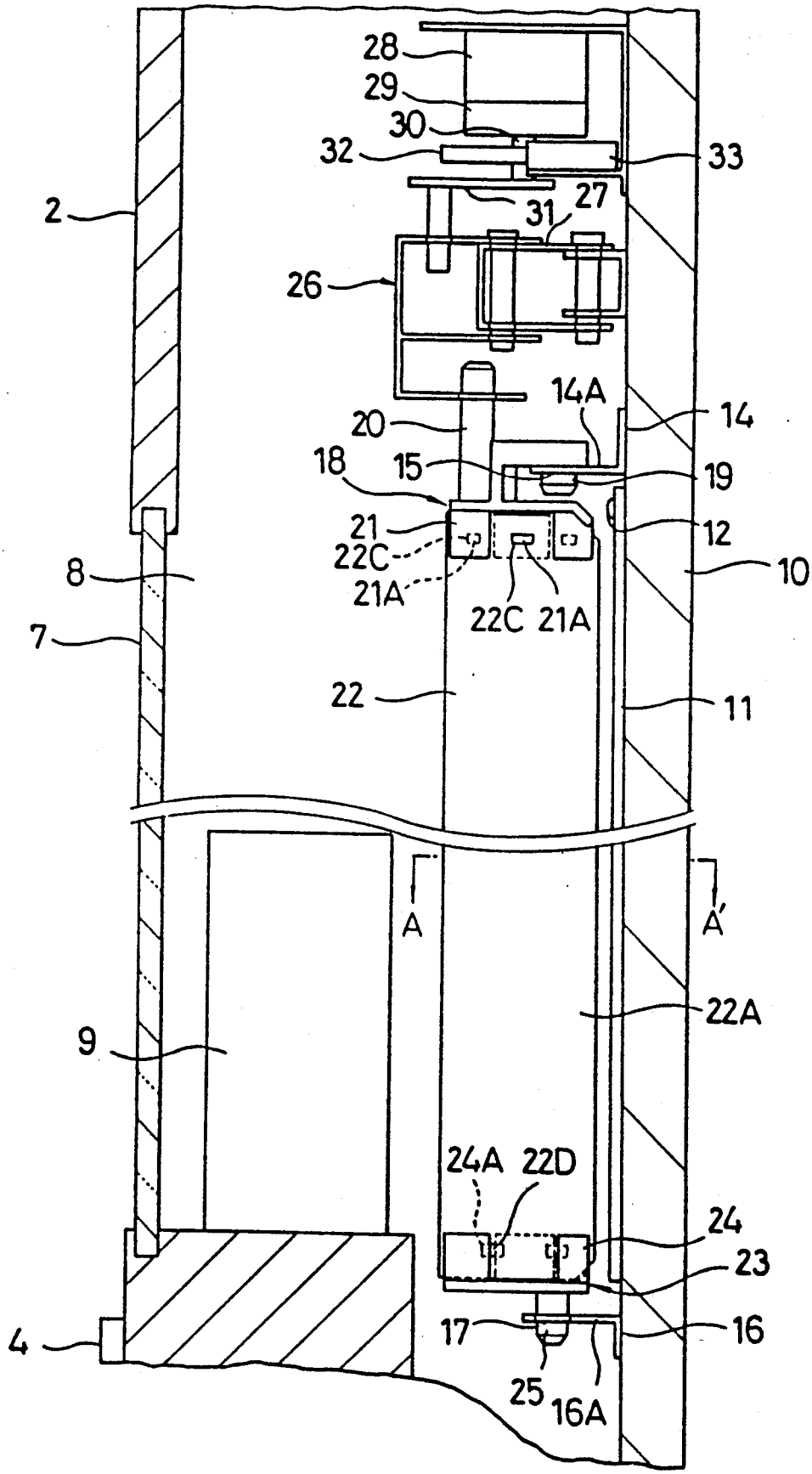

In FIG. 2, an interior door 10 is provided at the rear of the front door 2. The door 10 is swung together with the front door 2, and thereafter the door 10 can be opened separately from the front door 2 to expose the sample room 8. A display plate 11, on which a display figure, such as an article advertisement, is printed, is removably mounted on the interior door 10 by screws 12.

An elongate L-shaped angle 14 is secured to the interior door 10 at the upper part thereof and above the display plate 11. The forwardly extending horizontal portion 14A of the angle 14 has a plurality of holes 15 formed in a row in a lengthwise direction. The intervals of the holes 15 are substantially the same as the width of the display strips 22.

Another elongate L-shaped angle 16 is also secured to the interior door 10 at the lower part thereof and under the display plate 11. The forwardly extending horizontal portion 16A of the angle 16 has a plurality of holes 17 formed in vertical alignment with the associated holes 15.

Figure 3:
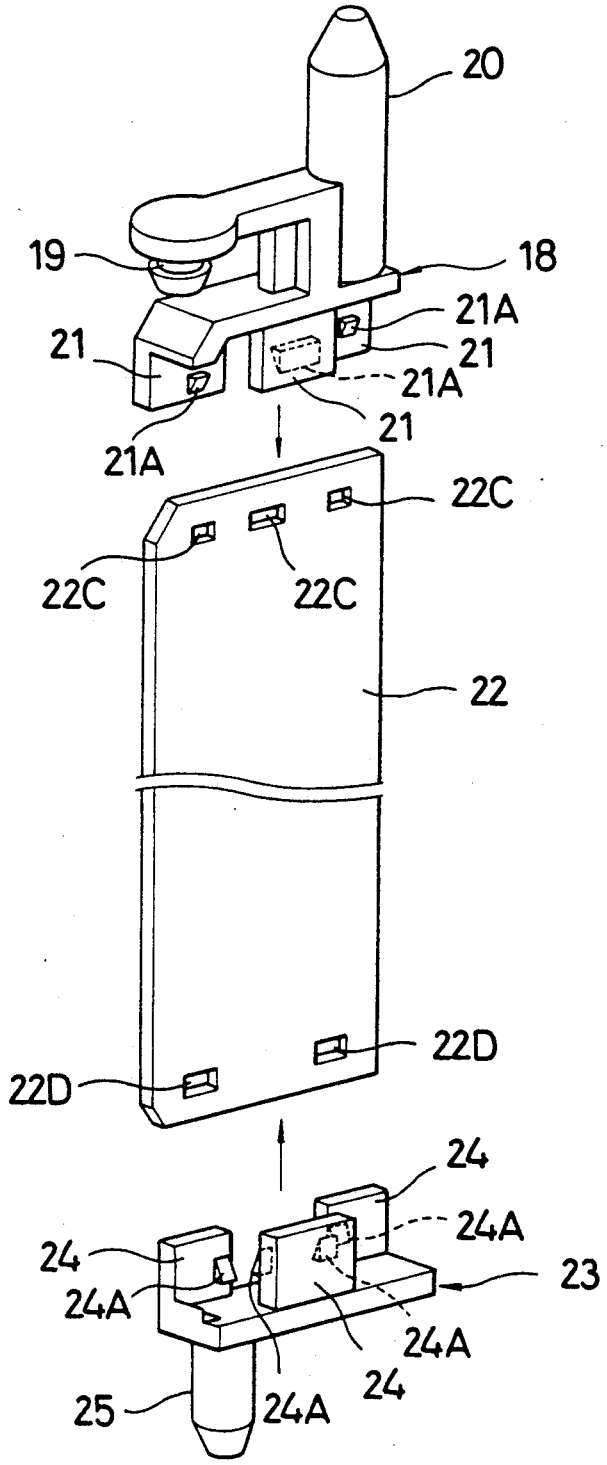

As best shown in FIG. 3, an upper support member 18 for grasping the upper end of a vertically elongate display strip 22 comprises a downward projection 19 extending from a body of the member 18, an upward projection 20 extending from the base of the member 18, and three fingers 21 alternately positioned in a zigzag fashion and extending from the base of the member 18 in a downward direction. The projection 19 freely extends through the hole 15 of the angle 14 to allow the rotation of the upper support member 18 with respect to the angle 14.

When the upper end of the strip 22 is inserted between the three fingers 21, projections 21A on the opposed faces of the fingers 21 are snap-fitted in the holes 22C formed at the upper end of the strip 22.

A lower support member 23 for grasping the lower end of the strip 22 comprises three fingers 24 alternately positioned in a zigzag fashion and extending from the base of the member 23 in an upward direction, and a downward projection 25 extending from the base of the member 23. The projection 25 extends through the hole 17 of the angle 16 to allow the rotation and the vertical movement of the lower support member 23 with respect to the angle 16.

When the lower end of the strip 22 is inserted between the three fingers 24, projections 24A on the opposed faces of the fingers 24 are snap-fitted in the holes 22D formed at the lower end of the strip 22.

The support members 18 and 23 is made of plastic material, and the fingers 21 and 24 are thin and flexible. Therefore, the support members 18 and 23 can be removed at need from the strip 22. The axis of the projection 19 is vertically aligned with that of the projection 25.

Figure 4:
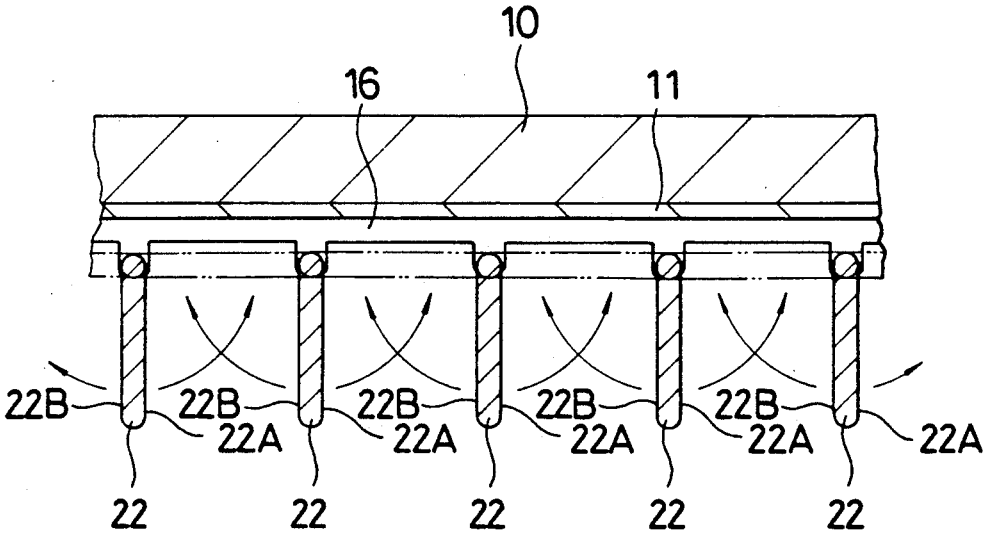
Figure 5:
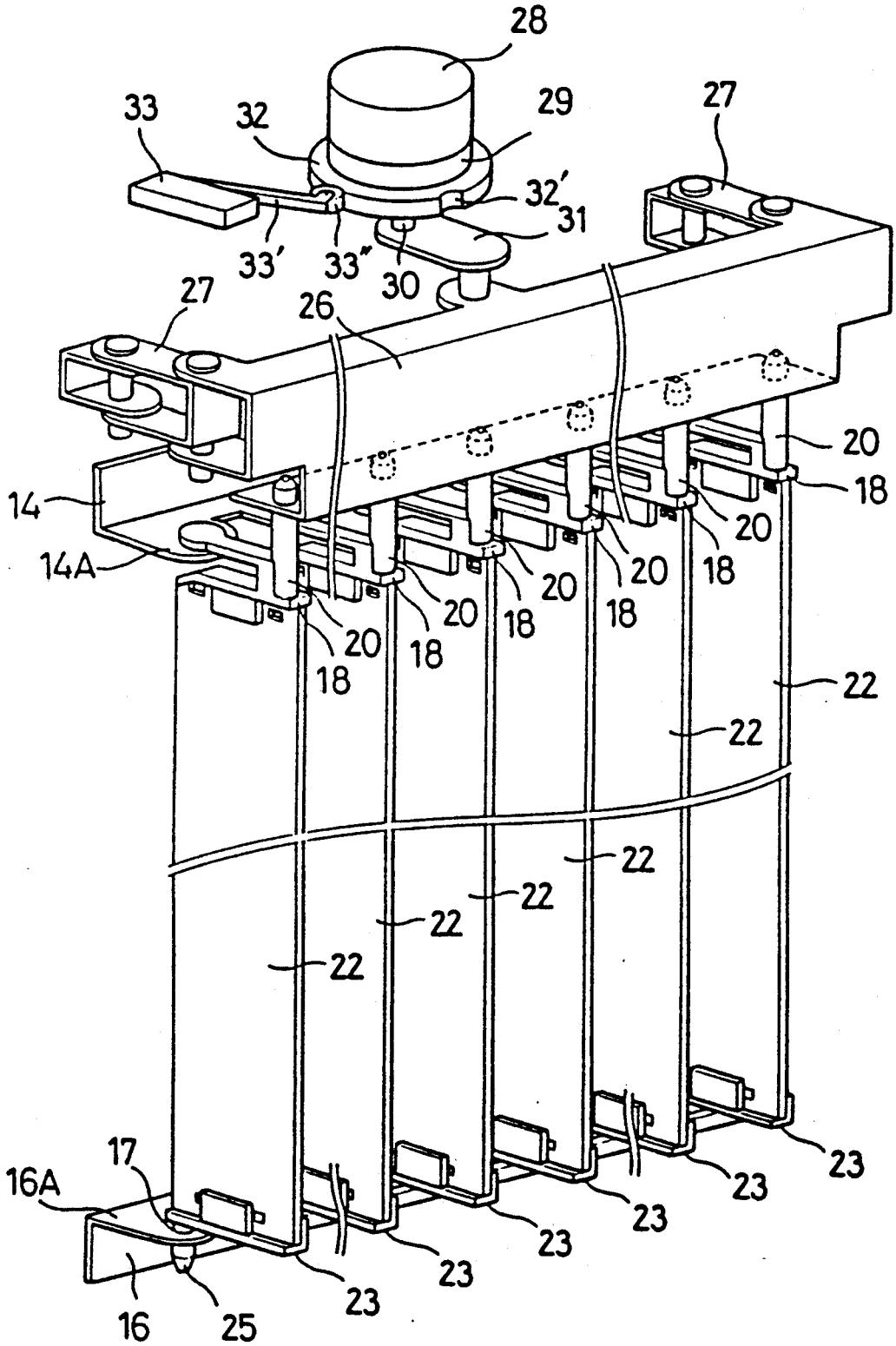

As will be understood from the above, the display strip 22 is pivotally supported about a vertical axis passing through the projections 19 and 25 so that the length of the strip 22 can expand or contract. Consequently, the display strip 22 can be prevented from being distorted by the change of temperature. Each display strip 22 is suspended by the L-shaped angle 14 through the upper support member 18, and the lower end of each display strip 22 is kept free, as the projection 25 of the lower support member 23 freely extends through the hole 17 in the L-shaped angle 16. It is understood that such a structure allows the length of the display strip to expand or contract in proportion to a change in temperature. Also, the display strip 22 can rotate in the clockwise or anticlockwise directions about a vertical axis passing through the projections 19 and 25. As shown in FIGS. 4 and 5, the display apparatus of the present invention has a plurality of display strips 22, and these strips 22 are arranged side by side at desired intervals and adjacent to the display plate 11. The front faces 22A and the rear faces 22B of the display strips 22 have display figures printed thereon. When the display strips rotate together at the same time about their own vertical axes in the clockwise or anticlockwise directions, and either the front faces 22A or the rear faces 22B of the display strips 22 take their positions parallel to the display plate, the display figures of the front faces 22A or the rear faces 22B of the display strips 22 cooperate with each other to produce associated composite figures, which fully covers the display figure of the display plate 11.

As will be understood from FIGS. 2 and 5, the upward projection 20 of each upper support member 18 is adapted to be freely rotatably supported by a transversely elongate U-shaped driving member 26, after passing through holes formed in the driving member. The driving member 26 is freely connected with a pair of linkage members 27 at its opposite ends so as to reciprocate in its lengthwise directions. A swing arm 31 is freely connected at an end thereof with the central part of the driving member 26, and is secured at the other end thereof to an output shaft 30 connected to a drive motor 28 through a reduction mechanism 29. The reciprocating motion of the driving member 26 is carried out when the drive motor 28 is rotated in the clockwise or anticlockwise directions. The drive motor 28 is provided with a control cam 32 in the form of a disk having three recesses 32' formed at equal distances along the periphery of the disk. A switch 33 for detecting the positions of rotation of the drive motor 28 is actuated by the fact that the roll 33" attached to a free end of an arm 33' of the detecting switch 33 is brought into engagement with any of the three recesses 32'. Such engagement corresponds to the case in which the front faces 22A or rear faces 22B of the display strips 22 take their positions parallel to, or at right angles to, the display plate 11.

Figure 6:
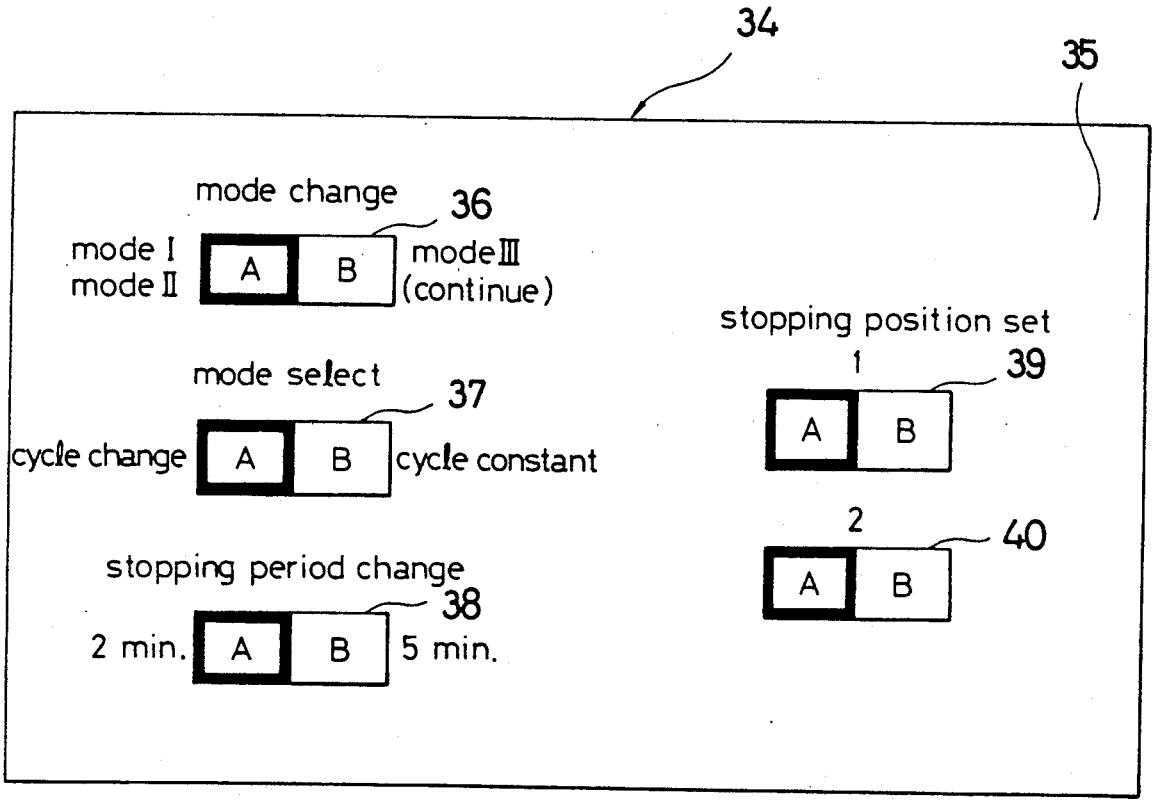
Figure 7:
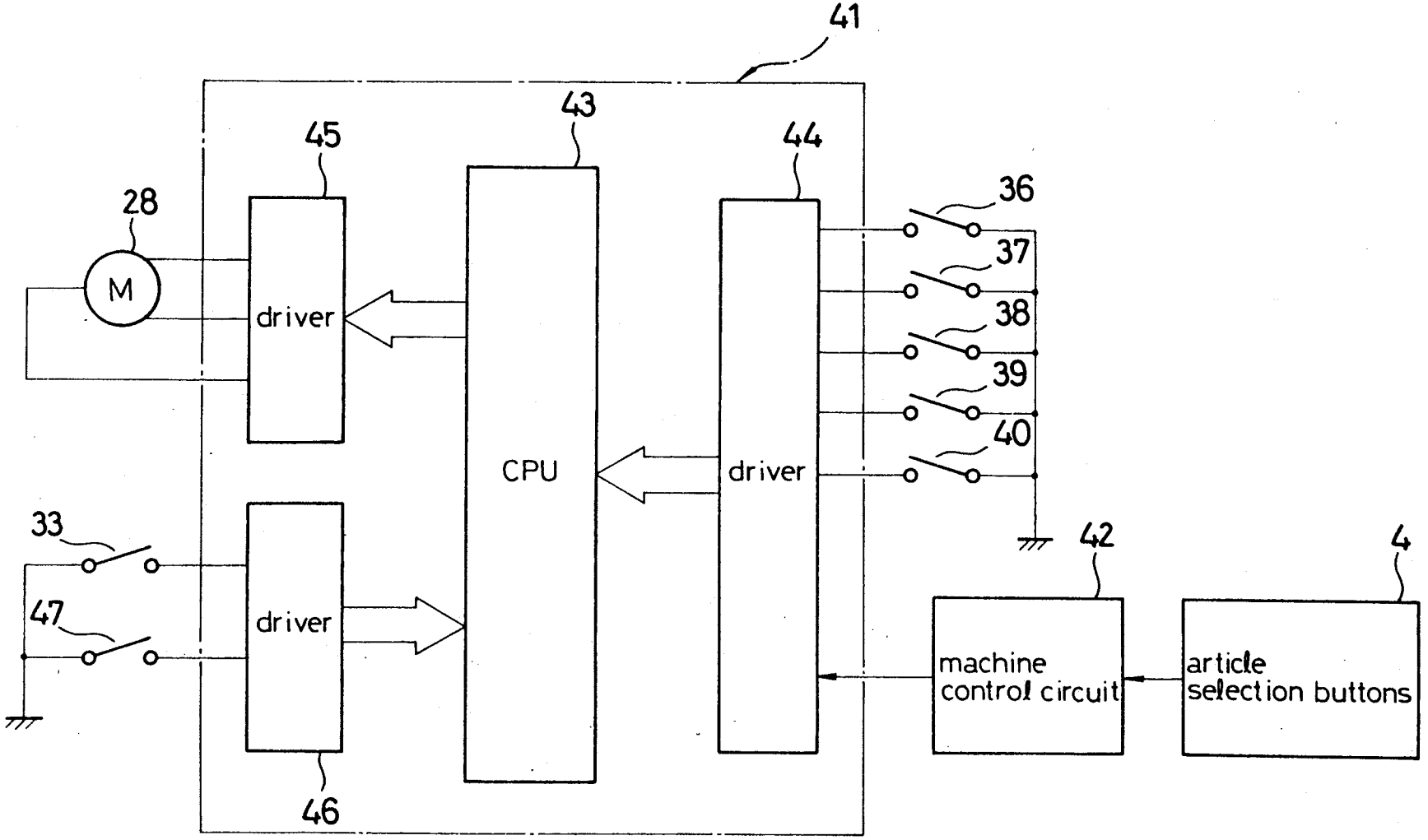

A control box 34 shown in FIG. 6 is attached to the rear wall of the service panel 5. The outside surface of the box 34 constitutes a switchboard 35, which contains a mode changing switch 36, a mode selection switch 37, a stopping period changing switch 38, a first stopping position setting switch 39, and a second stopping position setting switch 40.

The control box 34 contains a printed circuit board therein having a circuit 41 for controlling the movement of the display strips 22 and a circuit 42 for controlling the selling functions of the automatic vending machine itself. The control circuit 41 consists of a microcomputer (hereinafter referred to as CPU) 43 and three driving circuits 44, 45, and 46. Signals generated by the switches 36 to 40 on the switchboard 35 are inputted to the CPU 43 through the driving circuit 44. Also, signals generated by the switch 33 and a switch 47 for detecting the opening operation of the front door 2 are inputted to the CPU 43 through the driving circuit 46. Furthermore, signals based on the pushing operation of the article selection buttons 4 are inputted to the CPU 43 from the control circuit 42 through the driving circuit 44. Every time receiving a signal from the detecting switch 33, the CPU 43 checks input conditions of signals supplied from any of the switches 36 to 40, the detecting switch 47, and any of the article selection buttons 4, and then executes, depending on the input condition, the undermentioned various operation based on the programs stored in ROM (not shown), thereby moving the drive motor 28 in a clockwise or anticlockwise directions, or stopping the movement of the drive motor 28.

The following distances are all the same; the distance from the rotational axis of the output shaft 30 of the drive motor 28 to the rotational axis of the pin on the swing arm 31, the center to center distance of the holes on linkage members 27, and the distance from the rotational axis of the upward projection 20 to the rotational axis of projection 19.

When the drive motor 28 rotates the swing arm 31, for instance, in the left direction, the U-shaped driving member 26 moves in the same direction, whereby the display strips 22 rotate in the same direction about the vertical axes passing through the projections 19 and 25 of the support members 18 and 23, respectively. When the display strips 22 reach positions where the front faces 22A of the strips 22 are parallel to the display plate 11 with the front faces 22A facing front, the roll 33" of the detecting switch 33 engages one of the recesses 32' of the control cam 32, whereby the switch 33 operates to generate a signal, and sends it to the control circuit 41, thereby stopping the rotation of the drive motor 28. Consequently, the front faces 22A of all the display strips 22 cooperate with each other to produce a composite display figure A as shown in FIG. 8.

Next, the drive motor 28 is rotated in the reverse direction, so that the display strips 22 are rotated in the right directions. When the display strips 22 reach positions substantially at right angles to the display plate 11, the engagement of the control cam 32 with the roll 33" makes the detecting switch 33 operate in the same manner as mentioned above, whereby the switch 33 generates a signal to stop the rotation of the drive motor 28. Consequently, the display figure B of the display plate 11 shown in FIG. 9 can be seen passing through the spaces between the display strips 22, which are now positioned vertically of the display plate 11.

When the drive motor 28 is rotated further in the right direction, the display strips 22 are rotated in the same directions. When the display strips reach positions where the rear faces 22B of the strips 22 are parallel to the display plate 11 with the rear faces 22B facing forwardly, the detecting switch 33 generates a signal to stop the rotation of the drive motor 28 in the same manner as mentioned above. Consequently, the front rear faces 22B of all the display strips 22 cooperate with each other to produce a composite display figure C shown in FIG. 10.

Figure 8:
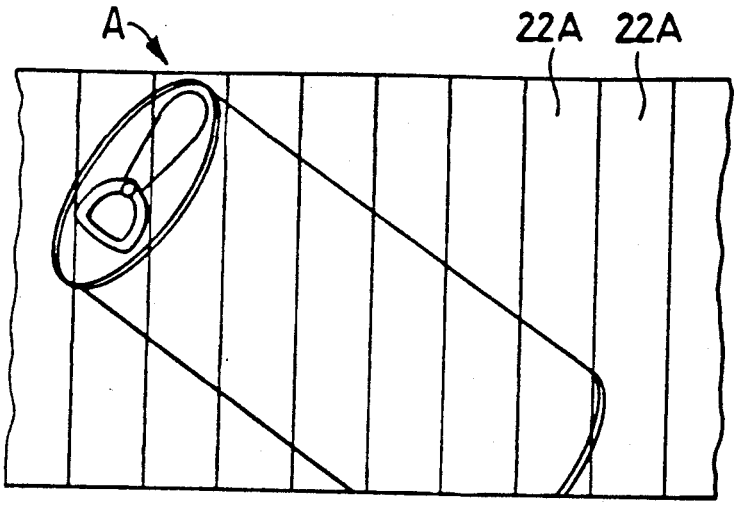
Figure 9:
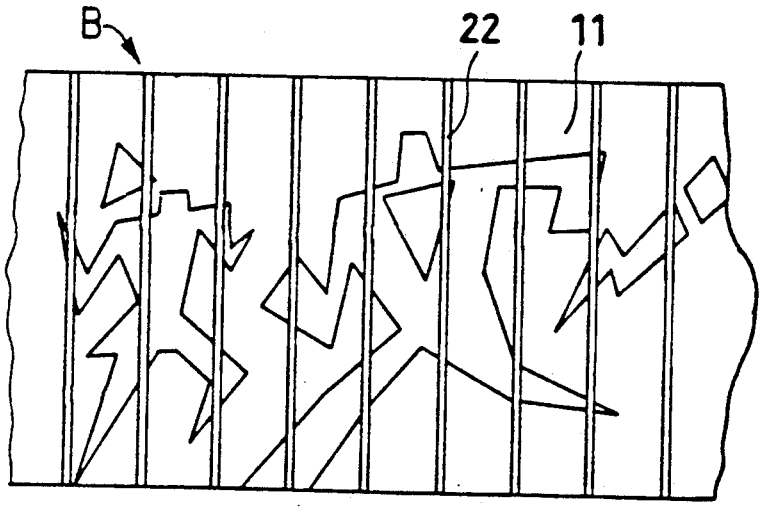
Figure 10:
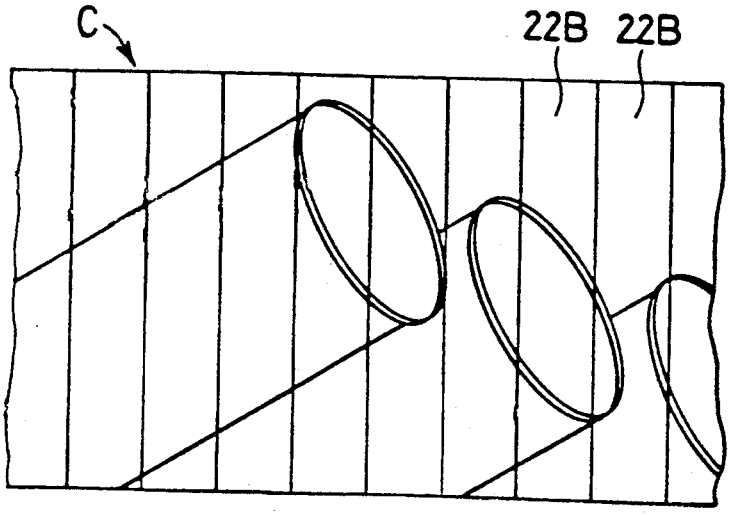

Thus, the display figures A, B, and C shown in FIGS. 8, 9, and 10, respectively, can intermittently be seen depending on the movement of the display strips as mentioned above. Such a mode of operating the display strips 22 to produce the display figures varies according to the cases where the automatic vending machine is on selling or stand-by for selling. Specifically, the display apparatus of the present invention has various modes depending on the manners of setting the several switches 36 to 40 on the switchboard 35 of the control box 34.

(1) Mode on stand-by for selling

Mode I

First, typically, a state A, shown in FIG. 8, that the front faces 22A of all the display strips 22 face front, changes to a state B, shown in FIG. 9, that the display strips 22 are at right angles to the display plate 11, after the lapse of about three seconds. After the state B holds for about five seconds, the display strips 22 are rotated to change to a state C, shown in FIG. 10, that the rear faces 22B of all the display strips 22 face front, after the lapse of about three seconds. After the state C holds for about five seconds, the display strips 22 are rotated in the reverse directions to return to the state B after the lapse of about three seconds. A cycle of Mode I is defined by the course of states A→B→C→B. After the latter state B stops for two or five minutes, the next cycles B→A→B→C continues. After all, Mode I consists of a cycle in which the display strips 22 move from a starting state up to a state just before the starting state, and a prescribed period after the end of the cycle.

Mode I is obtained by pushing the buttons "A" of both the mode changing switch 36 and the mode selection switch 37, and either the two minutes button "A" or the five minute button "B" of the stopping period changing switch 38 (see FIG. 6).

Mode II

First, typically, a state A, shown in FIG. 8, that the front faces 22A of all the display strips 22 face front, changes to a state B, shown in FIG. 9, that the display strips 22 are at right angles to the display plate 11, after the lapse of about three seconds. After the state B holds for about five seconds, the display strips 22 are rotated to change to a state C, shown in FIG. 10, that the rear faces 22B of all the display strips 22 face front, after the lapse of about three seconds. After the state C holds for about five seconds, the display strips 22 are rotated in the reverse direction to return to the state B after the lapse of about three seconds. After the state B holds for about five seconds, the display strips are further rotated to revert to the original state A. A cycle of Mode II is defined by the course of states A→B→C→B→A. After the latter state A stops for two or five minutes, the next cycle A→B→C→B→A continues. After all, Mode II consists of a cycle in which the display strips 22 move from a starting state up to the same state, and a prescribed time period after the end of the cycle.

Mode II is obtained by pushing the button "A" of the mode changing switch 36, the button "B" of the mode selection switch 37, and either the two minute button "A" or the five minute button "B" of the stopping period changing switch 38 (see FIG. 6). In Mode II each cycle is described as starting from the state A, or the starting state, of the previous cycle after the state A of each cycle stops two or five minutes. In other words, the state A is described as corresponding to a stopping position in every cycle. However, any of the states A, B, and C can be decided as corresponding to such stopping position by selectively pushing the combination of the switch buttons, "A" and "B", of the first and second stopping position setting switches 39 and 40.

Mode III

Mode III is a mode that should be modified from Mode I or Mode II by changing the stopping time period after the end of each cycle from two or five minutes as in Mode I or Mode II to about five seconds. Mode III is obtained by pushing the button "B" of the mode changing switch 36. Also, Mode I or Mode II can be changed from Mode III by pushing the button "A."

(2) Mode on selling

When the automatic vending machine begins a selling operation by pushing any of article selection buttons 4, the display apparatus of the present invention executes only one cycle of one of the Modes I, II, and III previously set.

(3) Other modes

When the front door 2 of the machine is opened, the control circuit 41 operates in response to the output of the detecting switch 47 based on the opening operation of the front door 2 to stop the drive motor 28 in a position where all the display strips 22 are parallel to the display plate 11. Thus, the distance between the samples 9 in the sample room 8 and the display strip 22 can be increased, and therefore the interchangeability of the samples 9 and the display strips 22 can become easy.

In the first embodiment, although each display strip 22 is attached at its upper and lower ends to the support members 18 and 23 so as to be rotatably supported by the upper and lower projections 19 and 25 thereof, and is operatively connected to the drive motor 28 through the projection 20 of the upper support member 18, the display strip 22 may be formed to have integral projections 19, 25 and 20.

Also, although the first embodiment shows that the display apparatus has a single sample room 8, the apparatus may have two sample rooms 8 as in a second embodiment of the present invention which will be explained below regarding FIGS. 11 to 16.

Figure 11:
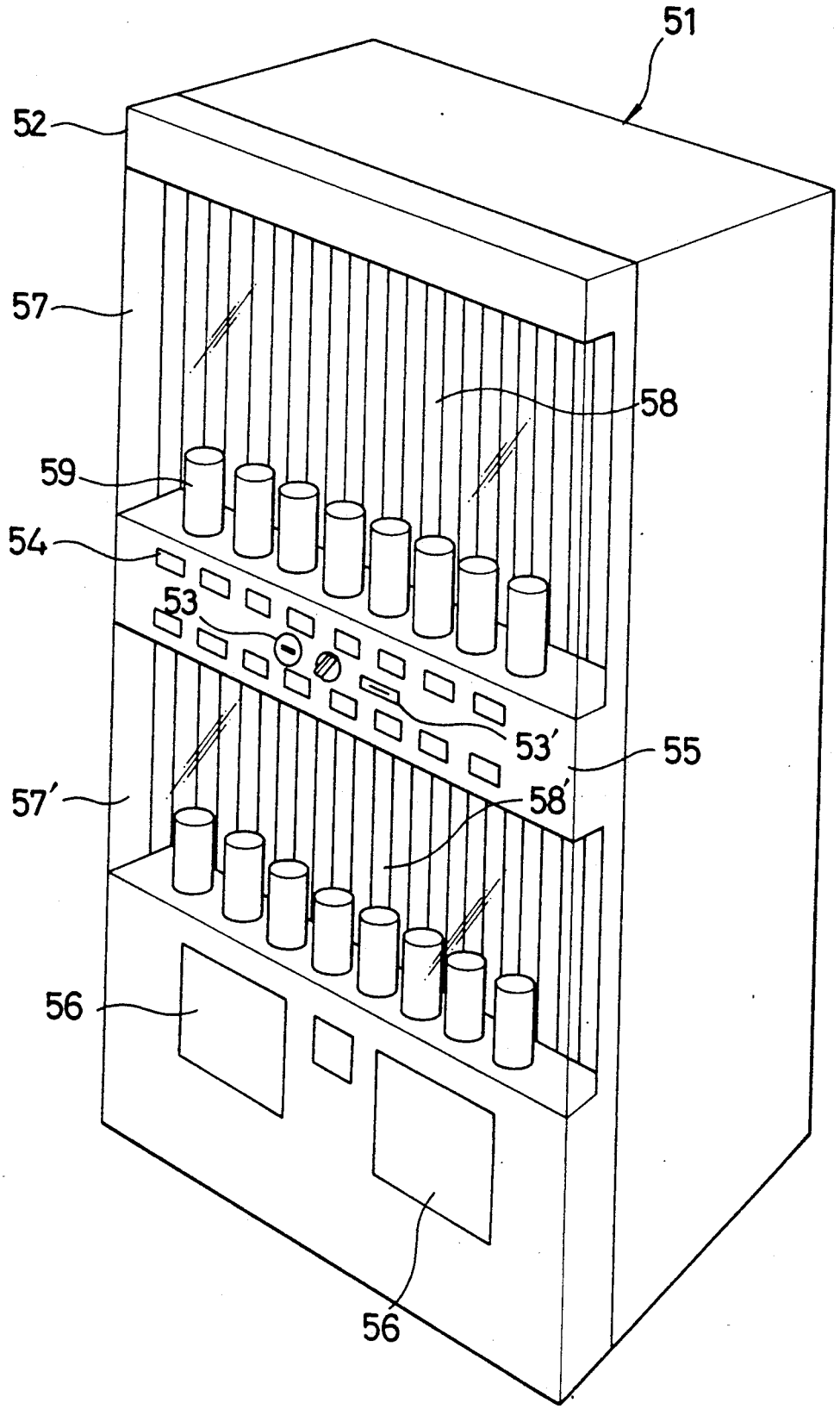
FIGS. 11 to 16 are drawings relating to a second embodiment of a display apparatus for an automatic vending machine or a slot machine according to the present invention.
Figure 12:
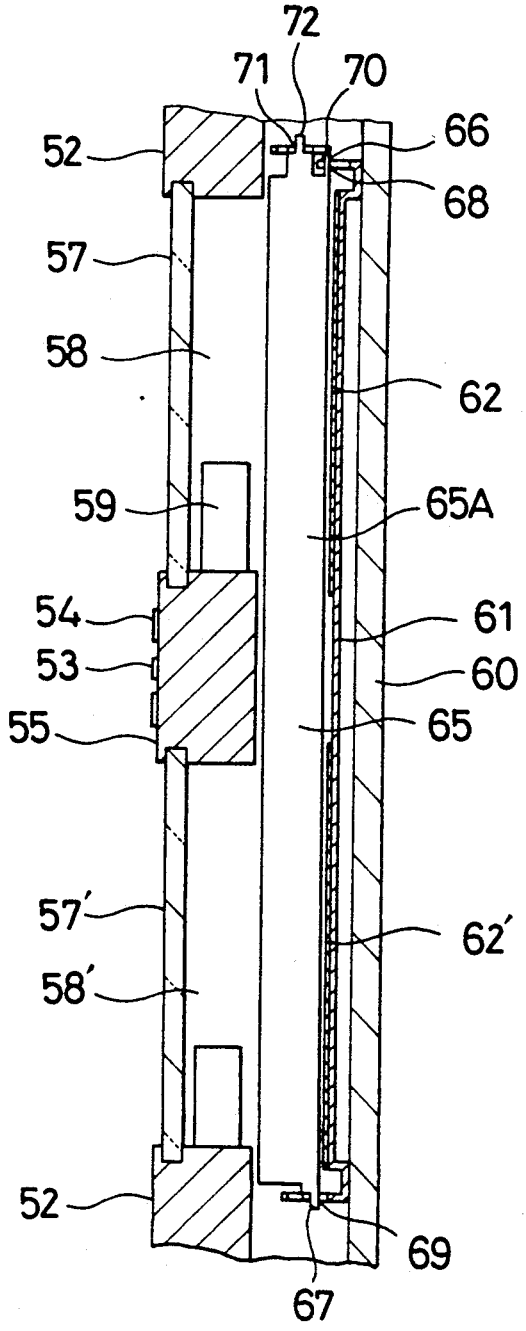

In FIGS. 11 and 12, an automatic vending machine has a body 51 and a front door 52 hinged to the body. The door 52 has a service panel 55, which is provided with a coin slot 53, a card slot 53', and a plurality of article selection buttons 54 arranged in two rows, article delivery windows 56, and an upper sample room 58 and a lower sample room 58' located on the upper and lower sides, respectively, of the service panel 55. The sample rooms 58 and 58' are covered by transparent window panels 57 and 57', respectively, which are fitted in the front door 52. Samples of articles of trade 59 are positioned in the upper and lower sample rooms 58 and 58' correspondingly to the article selection buttons 54.

Figure 13:
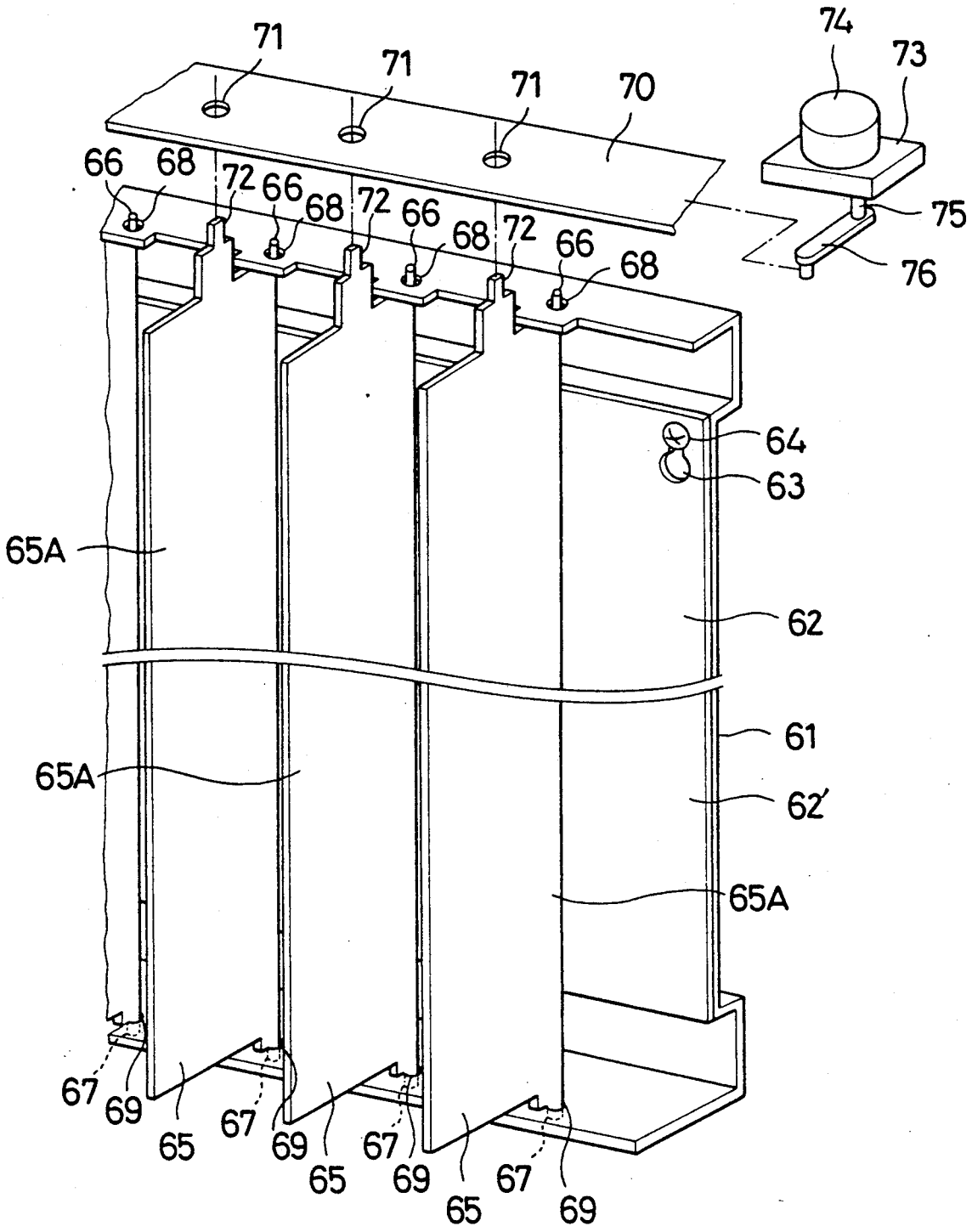
Figure 14:
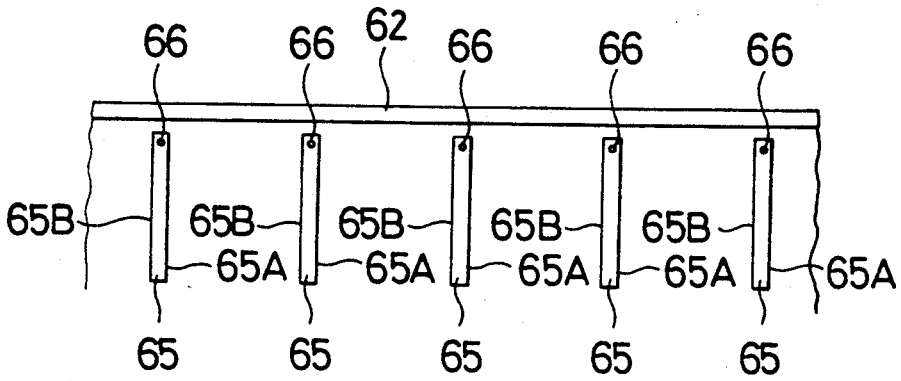
Figure 15:
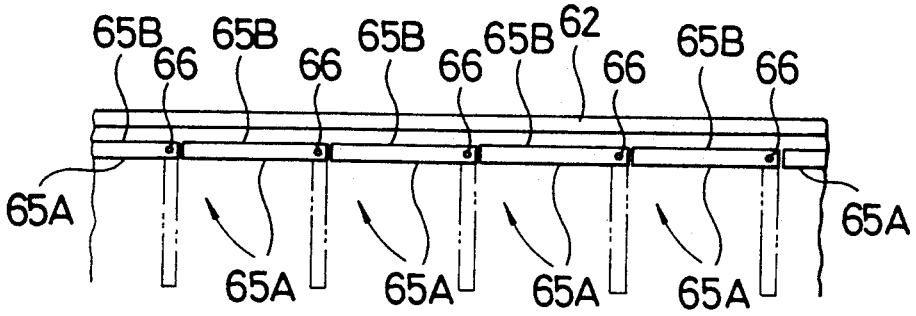
Figure 16:
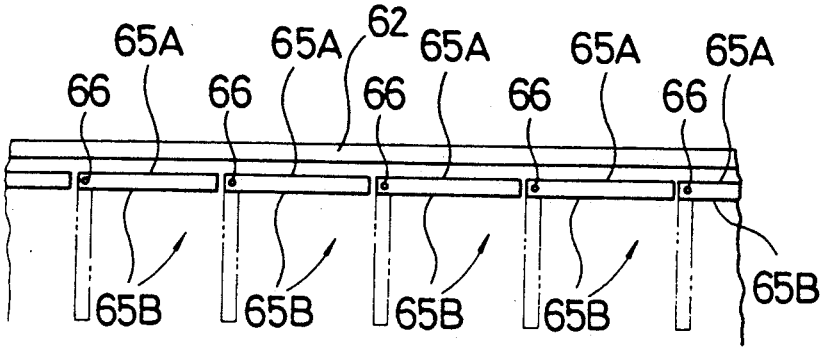

In FIGS. 12 and 13, an interior door 60 is provided at the rear of the front door 52. After being swung together with the front door 52, the interior door 60 can be opened separately from the front door 52 to expose the sample rooms 58 and 58'. The interior door 60 is provided at the front wall thereof with a mounting member 61. An upper and lower display plates 62 and 62', which have display figures or article advertisements printed thereon, are removably mounted on the mounting member 61 by the engagement of holes 63 with screws 64. The upper and lower display plates 62 and 62' are positioned in the sample rooms 58 and 58', respectively.

A plurality of vertically elongate display strips 65 are arranged side by side at desired intervals adjacent to the upper and lower display plates 62 and 62'. The front faces 65A and the rear faces 65B of the display strips 65 have display figures or article advertisements printed thereon. Each strip 65 is provided at the upper and lower ends of the rearward side edges thereof with an upwardly extending projection 66 and a downwardly extending projection 67, respectively. These projections 66 and 67 are freely received in holes 68 and 69, respectively, which are formed on the upper and lower transversely elongate U-shaped end portions of the mounting member 61, whereby the display strips 65 can rotate together at the same time about their own axes, each of which passes through the upper projection 66 and the lower projection 67, in the clockwise or anticlockwise directions. When, during the rotation of the display strips 65, either the front faces 65A or the rear faces 65B of the display strips 65 take their positions substantially parallel to the display plates 62 and 62', the faces of the display strips 65, which are arranged at desired intervals, can fully cover the display plates 62 and 62' so that the display figures of the plates cannot be seen. At that time, either the front faces 65A or the rear faces 65B of the display strips 65 can cooperate with each other to produce associated composite display figures (see FIGS. 15 and 16). When the display strips 65 take their positions substantially at right angles to the display plates 62 and 62' (see FIG. 14), the display figures of the display plates can be seen from before the front door 52 through the transparent window panels 57 and 57'.

As will be readily understood, the second embodiment of the display apparatus of the present invention can display six kinds of graphic figures. Specifically, three kinds of graphic figures can be seen from each of the upper and lower sample rooms 58 and 58', one figure from one of the upper and lower display plates 62 and 62' when the display strips 65 are substantially at a right angle to the display plates, and two figures from one of the front and rear faces 65A and 65B of the display strips 65 when the display strips are in the positions substantially parallel to the display plates. Therefore, for example, two kinds of landscape pictures or photographs and an explanative display of articles of trade can be seen through the upper sample room 58, and three kinds of trademarks can be seen through the lower sample room 58'.

As best shown in FIG. 13, a plate-like driving member 70 has a plurality of holes 71 arranged in a row at the same distances as the holes 68 or 69, or substantially the width of the display strips 65. A projection 72 extending upwardly from substantially the central part of the top end of each display strip 65 is freely passed through the hole 71. The driving member 70 is freely connected at an end thereof with an end of a swing arm 76, the other end of which is secured to an output shaft 75 of a drive motor 74 through a reduction mechanism 73. As a result, the display strips 65 can be rotated alternately in the clockwise or anticlockwise directions about their own vertical axes passing through the projections 66 and 67 by the drive motor 74 to reciprocate within the range of an angle of about 180 degrees, thereby alternately facing the front faces 65A or the rear faces 65B of the display strips 65 forwards to prevent the display plates 62 and 62' from being seen from the front of the machine.

In the second embodiment, likewise in the first embodiment, the automatic vending machine is, of course, provided at the rear wall of the service panel 55 with a control box, and the outside surface of the box constitutes a switchboard which contains various operation switches, whereby several mods of display operations can be carried out. Such a device and its functions will be readily understood without explaining them, and therefore their descriptions are omitted.

A third embodiment of the display apparatus of the present invention will now be described with respect to FIGS. 17 to 20.

Figure 17:
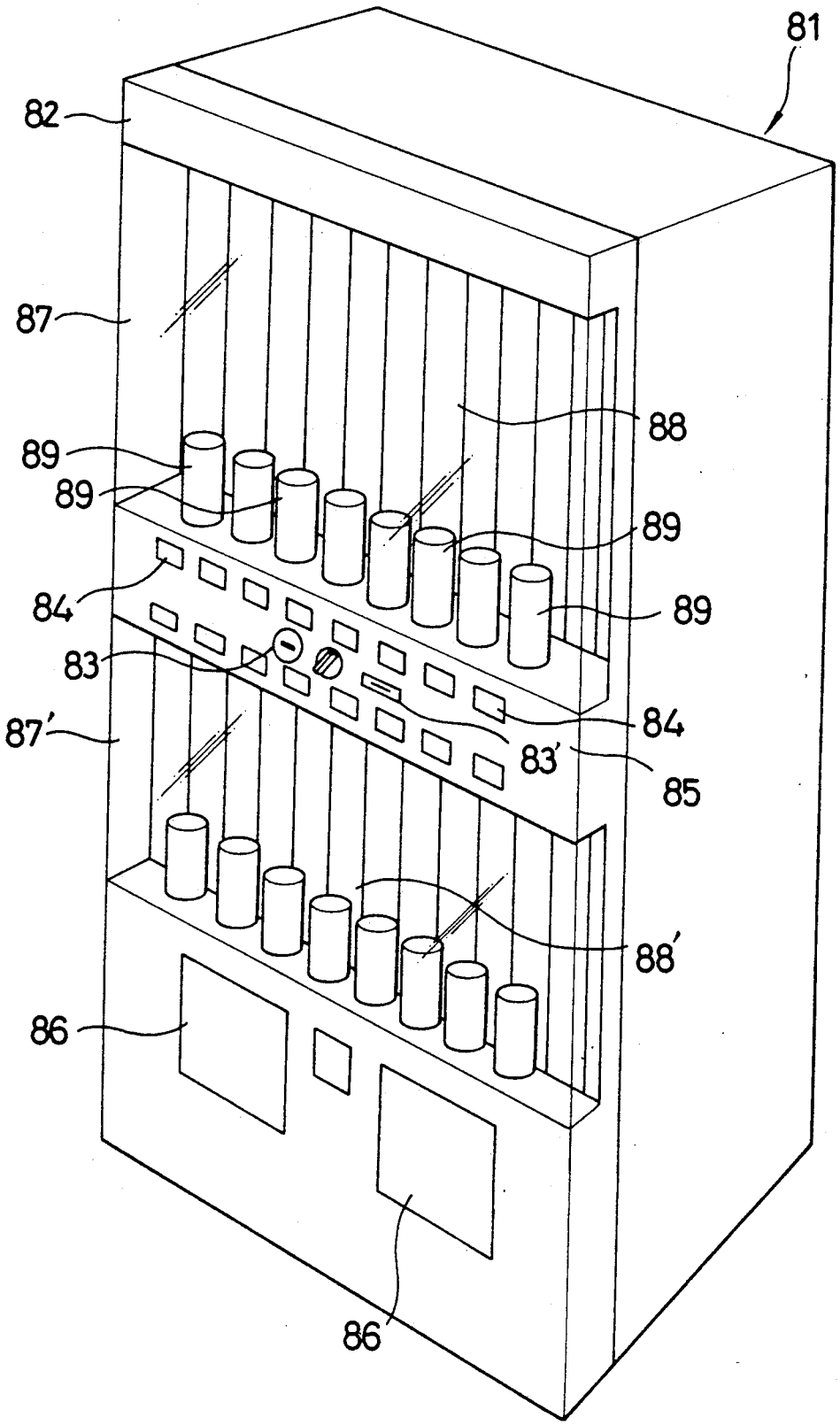
FIGS. 17 to 20 are drawings relating to a third embodiment of a display apparatus for an automatic vending machine or a slot machine according to the present invention.
Figure 18:
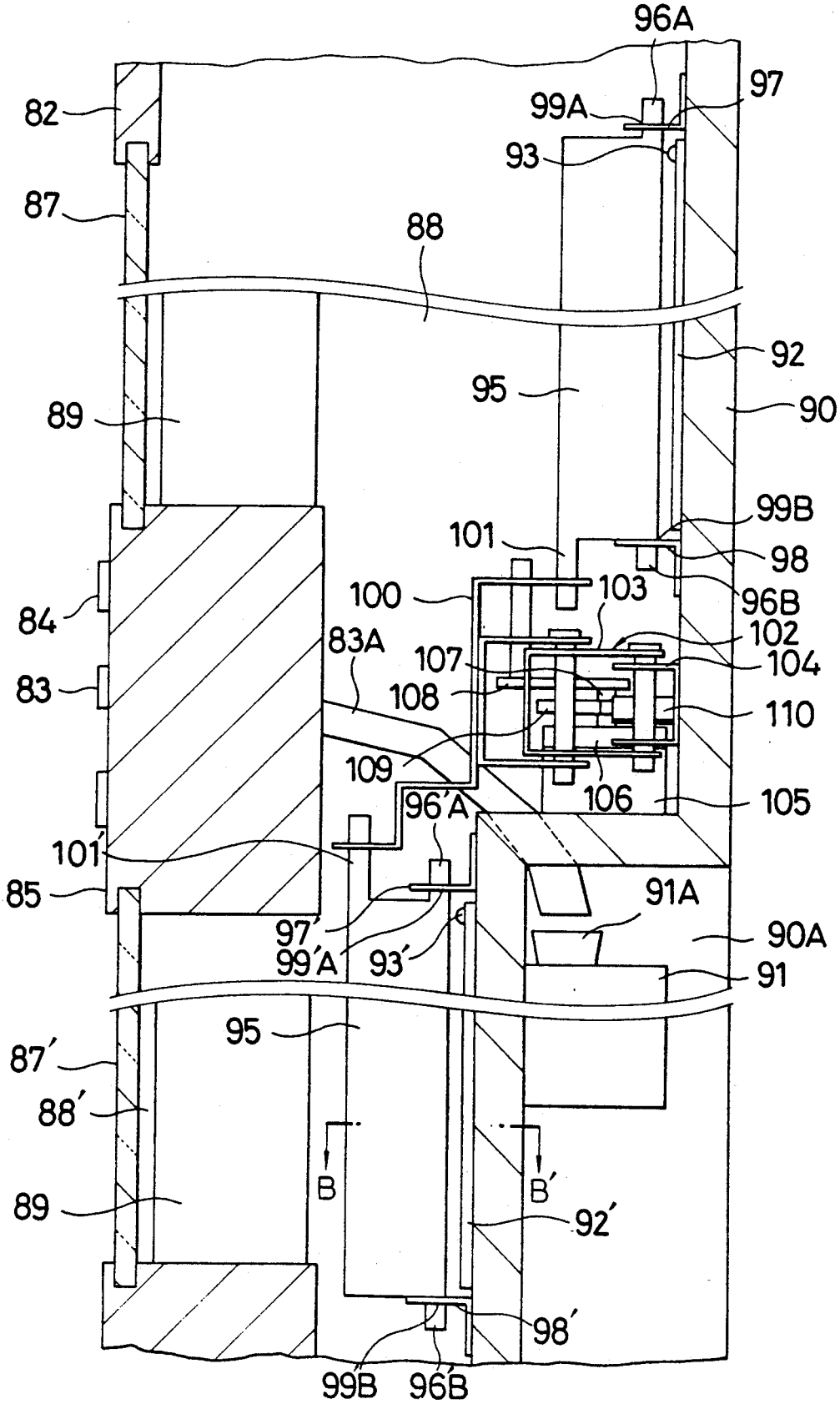

In FIGS. 17 and 18, an automatic vending machine has a body 81 and a front door 82 hinged to the body. The door 82 has a service panel 85, which is provided a coin slot 83, a card slot 83', and a plurality of article selection buttons 84 arranged in two rows, article delivery windows 86, an upper sample room 88 and a lower sample room 88' located on the upper and lower sides, respectively, of the service panel 85. The samples rooms 88 and 88' are covered by transparent window panels 87 and 87', respectively, which are fitted in the front door 82. Samples of articles of trade 89 are positioned in the upper and lower sample rooms 88 and 88' correspondingly to the article selection buttons 84.

As best shown in FIG. 18, an interior door 90 is provided at the rear of the front door 82. After being swung together with the front door 82, the interior door 90 can be opened separately from the front door 82 to expose the sample rooms 88 and 88'. The interior door 90 is folded to project its lower portion forwards thereby providing a coin counting station 90A at the rear side thereof. A coin counter 91 is located in the station 90A, and has a hopper 91A under the outlet of a chute 83A, the inlet of which communicates with the coin slot 83. The interior door 90 is provided on the front walls facing the upper and lower sample rooms 88 and 88' with an upper display plate 92 and a lower display plate 92', respectively, which are removably attached to the associated display plates by screws 93 and 93', respectively. These display plates 92 and 92' have display figures or article advertisements printed thereon.

A plurality of vertically elongate upper and lower display strips 95 and 95' are arranged side by side at desired intervals adjacent to the upper and lower display plates 92 and 92', respectively. The front faces 95A and 95'A, and the rear faces 95B and 95'B, of the upper and lower display strips 95 and 95', respectively, have display figures or article advertisements printed thereon. Each upper display strip 95 is provided at the upper and lower ends of the rearward side edges thereof with projections 96A and 96B extending upwardly and downwardly from the upper and lower ends, respectively, of the strip 95. These projections 96A and 96B are freely received in holes 99A and 99B, respectively, which are formed on upper and lower elongate L-shaped mounting members 97 and 98, respectively, secured to the upper portion of the interior door 90 at the opposite sides of the upper display plate 92 spaced apart from the upper and lower ends thereof. In the same way, each lower display strip 95' is provided at the upper and lower ends of the rearward side edges thereof with projections 96'A and 96'B extending upwardly and downwardly from the upper and lower ends, respectively, of the strip 95'. These projections 96'A and 96'B are freely received in holes 99'A and 99'B, respectively, which are formed on upper and lower elongate L-shaped mounting members 97' and 98', respectively, secured to the upper portion of the interior door 90 at the opposite sides of the lower display plate 92' spaced apart from the upper and lower ends thereof. The intervals of the holes 99A, 99B, 99'A or 99'B are substantially the same as the width of these display strips 95 or 95'. Consequently, the display strips 95 and 95' can be rotated alternately in the clockwise or anticlockwise directions about their own vertical axes passing through the projections 96A and 96B of the upper strips 95 and the projections 96'A and 96'B of the lower strips 95', respectively, to reciprocate within the range of an angle of about 180 degrees, thereby alternately facing the front faces 95A and 95'A of these display strips 95 and 95', respectively, or the rear faces 95B and 95'B of these display strips 95 and 95', respectively, front to prevent the display plates 92 and 92' from being seen from the front of the machine.

Figure 19:
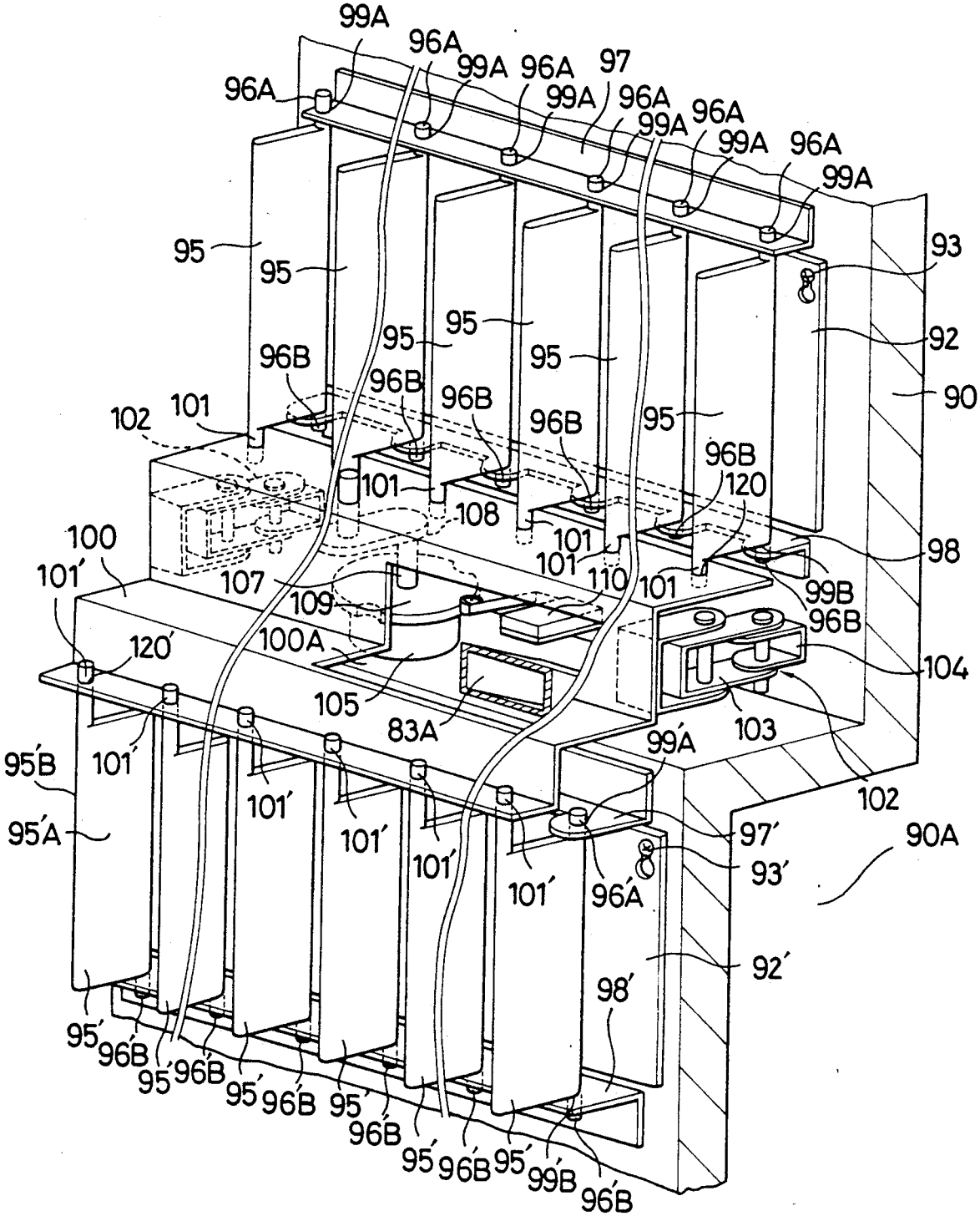

As shown particularly in FIGS. 18 and 19, a transversely elongate angular driving member 100 is located at the rear of the service panel 85, and contains an upper and lower horizontal plane portions having a plurality of holes 120 and 120', respectively, each of these holes being arranged in a row at the same intervals as the holes 99A, 99B, 99'A, or 99'B, or substantially the width of the display strips 95 or 95'. A connecting projection 101 extending downwardly from the forward end of the bottom of each upper display strip 95 is freely passed through the hole 120. A connecting projection 101' extending upwardly from the forward end of the top of each lower display strip 95' is freely through the hole 120'. The driving member 100 is freely connected with a pair of linkage members 102 at its opposite ends so as to reciprocate in its lengthwise directions. The driving member 100 has an aperture 100A substantially at its central portion to allow the chute 83A to pass through so that the transversely reciprocating movement of the driving member 100 cannot be prevented. Each linkage member 102 comprises a U-shaped part 103, which is fixed to the driving member 100, and another U-shaped part 104, which is fixed to the front surface of the upper portion of the interior door 90, the U-shaped part 103 being operatively connected with the other U-shaped part 104 to be rotatable relative to the latter.

A drive motor 105 is placed on the shoulder formed in the interior door 90 at the rear of the driving member 100, and is connected to an output shaft 107 through a reduction mechanism 106. A swing arm 108 is freely connected at an end thereof with a portion near the central part of the driving member 100, and is secured at the other end thereof to an output shaft 107, which is connected to the drive motor 105 through a reduction mechanism 109. The reciprocating motion of the driving member 100 is carried out when the drive motor 105 is rotated in the clockwise or anticlockwise directions.

The drive motor 105 has a control cam 109 secured to the output shaft 107 thereof. The cam 109 has a contour and functions that are similar to those of the cam 32 described in the first embodiment, is adapted to operate a detecting switch 110 when either the front or rear faces 95A, 95B, 95'A, or 95'B of the upper or lower display strips 95 or 95' rotate to a position facing front, and, in other words, these faces are substantially parallel to, or are substantially at right angles to, the display plates 92 or 92'.

Specifically, when the drive motor 105 rotates the swing arm 108, for instance, in the clockwise directions, the driving member 100 moves in the left direction in FIG. 19, and the upper and lower display strips 95 and 95' rotate in the clockwise directions about their own axes passing through the projections 96A and 96B of the upper display strips 95 and the projections 96'A and 96'B of the lower display strips 95', respectively. When the front faces 95A and 95'A of the upper and lower display strips 95 and 95', respectively, reach positions facing front, the control cam 109 operates the detecting switch 110, and then the switch 110 outputs a signal to a control circuit not shown, thereby stopping the movement of the drive motor 105, and to begin reversing it to rotate in the anticlockwise directions. It is noted that when the front faces of the display strips reach the position facing front, they cover the display plates to prevent the graphic figures of the display plates from being seen.

Figure 20:
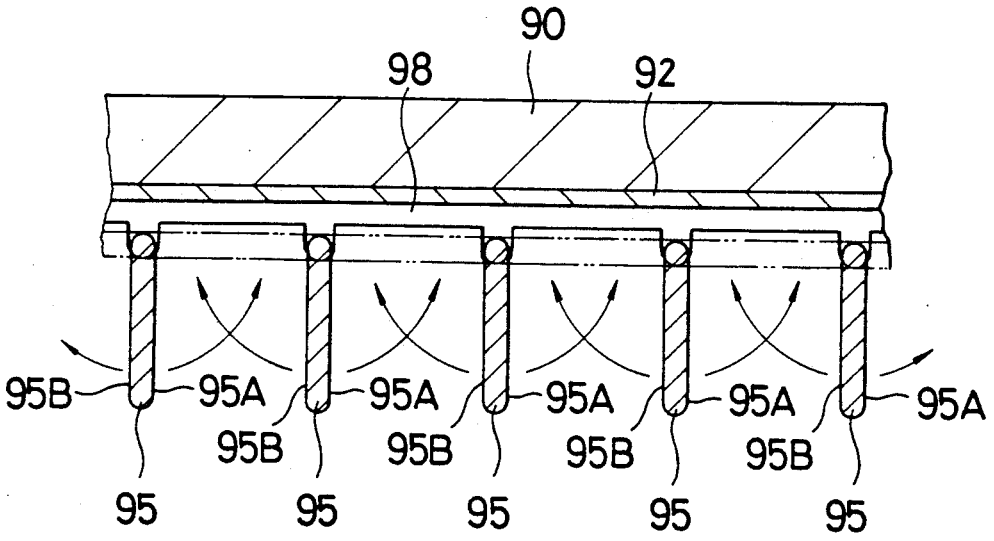

Next, when the display strips 95 and 95' reach positions substantially at right angles to the display plates 92 and 92' by the anticlockwise rotation of the drive motor 105 as shown in FIG. 20, the detecting switch 110 is operated again by the control cam 109 to output a signal to the control cam for stopping the rotation of the motor 105 for the prescribed period. At that time, the graphic figures of the display plates 92 and 92' can be seen from the front of the machine passing through the spaces between the display strips.

After the lapse of the prescribed period, the display strips 95 and 95' are rotated further in the anticlockwise directions. When the rear faces 95B and 95'B of the display strips 95 and 95', respectively, reach positions facing front, the detecting switch 110 is operated further by the control cam 109 to output a signal to the control cam for stopping the movement of the motor 105, and to begin reversing it to rotate in the clockwise directions. At that time, the rear faces 95B and 95'B of the strips 95 and 95' prevent the graphic figures of the display plates 92 and 92' from being seen from the front of the machine.

Figure 21:
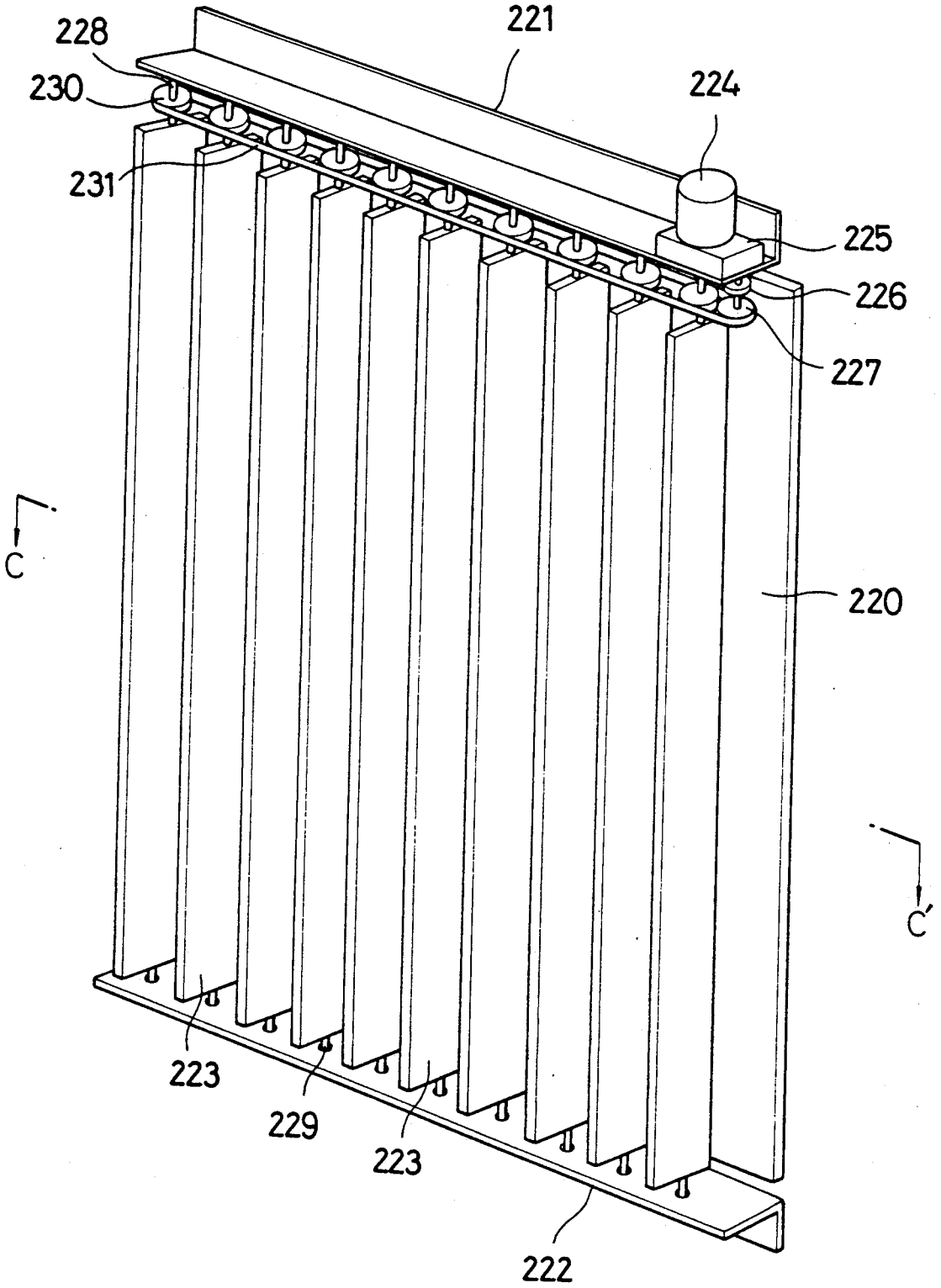
FIGS. 21 to 23 are drawings relating to a fourth embodiment of a display apparatus for an automatic vending machine or a slot machine according to the present invention.
Figure 22:
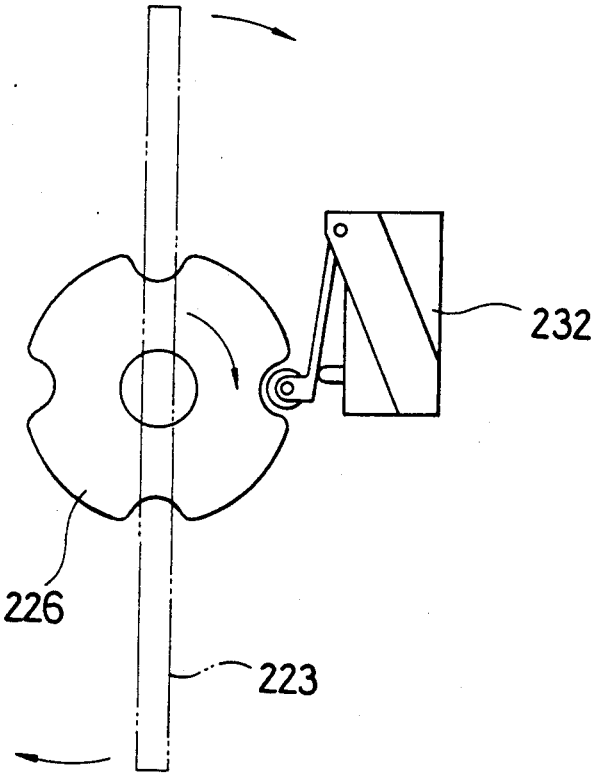
Figure 23:
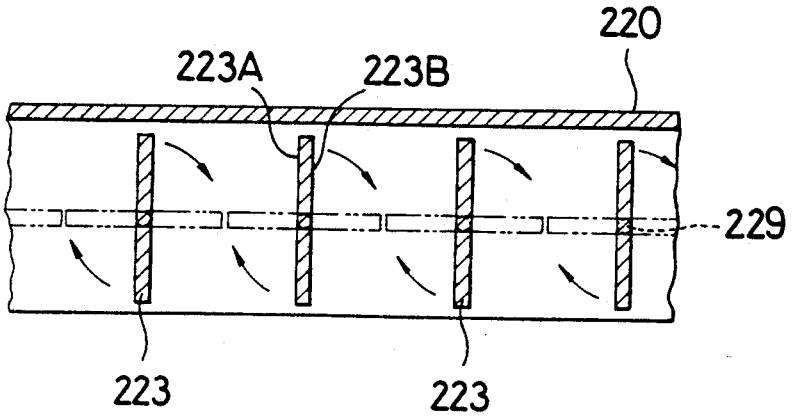

A fourth embodiment of the display apparatus of the present invention will be explained with respect to FIGS. 21 to 23, showing only the principal part of the display apparatus of the present invention. The figures of an exterior view of an automatic vending machine, a cross-sectional view of a sample room, and so on, are not attached here, because the fourth embodiment will be readily understood without these figures.

A display plate 220 is removably attached to the rear wall of a sample room, or the front wall of an interior door, of the automatic vending machine, not shown. Also, to the front wall of the interior door are fixed a pair of transversely elongate L-shaped mounting members 221 and 222 at the opposite sides of the display plate 220 spaced apart from the upper and lower ends of the plate 220. A plurality of vertically elongate display strips 223 are freely attached to the mounting members 221 and 222 at substantially the same distances as the width of each strip, to be rotatable about their own axes passing through a pair of upper and lower projections 228 and 229, which extend upwardly and downwardly, respectively, from the centers of the top and bottom ends of each display strip 223, and which freely pass through holes provided on the pair of mounting members 221 and 222 so as to be in a row at the same intervals as the projections 228 and 229, respectively. A drive motor 224 is securely mounted on the horizontal plane of the upper L-shaped mounting member 221. The power of the motor 224 is transmitted to a control cam 226 in the form of a disk and a main gear 227 through a reduction mechanism 225. A driven gear 230 is fixedly inserted by each of the upper projections 228 of the display strips 223. The driven gears 230 are operatively connected with each other and the main gear 227 by an endless timing belt 231.

As will be readily understood from the above, the front and rear faces 223A and 223B of the display strips 223 can alternately take positions parallel to the display plate 220 by rotating the drive motor 224 in only a single direction, clockwise or anticlockwise. Also, it will be readily understood that, while the motor 224 rotates, the front and rear faces 223A and 223B of the display strips 223 can take positions at right angles to the display plate 220 to allow the plate to be seen from the front of the machine, passing through the spaces between the display strips 223.

The front and rear faces 223A and 223B of the display strips 223 stop at the above-mentioned positions for prescribed periods. These positions can be detected when a free roll attached to a switch shown in FIG. 22 engages recesses of the control cam 226. The cam has four recesses along its periphery at regular intervals. Signals generated based on such detection of the above-mentioned positions are transmitted to a control circuit (not shown), and the movement of the drive motor 224 is adapted to be controlled by the control circuit, as in the same manner as explained in detail in the first embodiment.

We claim:

1. An automatic vending machine provided with a display apparatus, comprising:

a sample room for exhibiting samples of articles of trade which is covered by a transparent window panel fitted in a front door of said vending machine, a display plate having a display figure formed thereon, said plate being located on a rear wall of said sample room, a plurality of vertical elongate display strips, which are arranged side by side at desired intervals, said strips being located adjacent to said display plate and being rotatable about their own vertical axes so that when said display strips rotate together at the same time, either front faces or rear faces, of said display strips take their positions substantially parallel to said display plate, said faces including front faces and rear faces which cooperate with each other to produce an associated composite display figure that fully covers the display figure of said display plate, driving means for rotating all the display strips at the same time about their own vertical axes, control means for controlling the movement of said display strips to temporarily hold the display strips in a position where a face of each strip is substantially perpendicular to said display plate and in a position where either the front face or the rear face of each strip is substantially parallel to said display plate, said driving means rotating said display strips in response to said control means so that the display figure of said plate and the composite display figures to be produced by the front and rear faces of said display strips may be intermittently seen at predetermined time-intervals through said transparent window panel, each of said display strips being rotatable into a position substantially parallel to said display plate, further comprising detecting means responsive to opening said front door for generating a detection signal, said control means comprising means responsive to said detection signal when each of said display strips is free of said position substantially parallel to said display plate for operating said drive means to rotate each of said display strips until said display strips take such a parallel position, each of said display strips having a rearward edge, and means for suspending said display strips so that said display strips are rotatable about a vertical axis adjacent to said rearward edge and so that a lower end of each of said display strips is kept free from contacting a floor of the sample room to enable a length of said strip to expand or contract in proportion to a change in temperature.

2. An automatic vending machine according to claim 1, wherein said driving means comprise a transversely elongated driving member with which a projection extending vertically from a forward end of the top of each display strip is freely rotatable connected;

a pair of linkage members freely connected with opposite ends of said transversely elongated driving member for allowing reciprocation in lengthwise directions of said transversely elongated driving member;

a swing arm connected with a central area of said driving member spaced away from said forward end and said opposite ends; and a drive motor connected with said swing arm through a reduction mechanism for rotating the display strips together about their own vertical axes selectively in clockwise and counter-clockwise directions.

3. An automatic vending machine according to claim 1, wherein said control means actuate movement of said display strips in response to a signal based on a selling operation of said automatic vending machine.

4. An automatic vending machine according to claim 3, further comprising means for generating said signal in response to any of a plurality of article selection buttons being activated during the selling operating being initiated.

5. An automatic vending machine according to claim 3, further comprising:

means for receiving coins or a card; and means responsive to said receiving means for generating said signal.

6. An automatic vending machine according to claim 3, further comprising means for generating said signal when coins are put in a coin slot and reach a due amount of charges for selling the relevant articles of trade.

7. An automatic vending machine according to claim 1, wherein said control means comprises means for stopping movement of said display strips for a predetermined time period after an end of each cycle in which said display strips return from a starting position of their movement to a starting position.

8. An automatic vending machine according to claim 7, wherein said control means comprises means for selectively stopping movement of each display strip for a predetermined time period in a position where a face of each strip is substantially at right angles to said display plate, and in a position where a face of each strip is substantially parallel to said display plate.

9. An automatic vending machine according to claim 7, wherein said control means comprises mode changing means for switching a mode of stopping the movement of said display strips for a predetermined time period after the end of each cycle, with a mode of continuing the movement of said display strips without intermission after the end of each cycle.

10. An automatic vending machine according to claim 1, wherein said control means comprises means for stopping the movement of said display strips for a predetermined time period after the end of each cycle in which said display strips move from a starting position of their movement to a position where they temporarily stop just before the starting position.

11. An automatic vending machine according to claim 10, wherein said control means comprises mode changing means for switching a mode of stopping the movement of said display strips for a prescribed time period after the end of each cycle, with a mode of continuing movement of said display strips without intermission after the end of each cycle.

12. An automatic vending machine provided with a display apparatus, comprising upper and lower sample rooms for exhibiting samples of articles of trade, the upper and lower rooms being located on both sides, respectively, of a service panel which is attached to a front door of said vending machine, each of said sample rooms, being covered by a transparent window panel which is fitted in said front door, upper and lower display plates each having a display figure formed thereon, said plates being located on rear walls of said upper and lower sample rooms, respectively, a plurality of vertically elongate display strips which extend to both sample rooms and arranged side by side at desired intervals, said strips being located adjacent to an associated one of said upper and lower display plates and being rotatable about their own vertical axes, said display strips each having a front face and a rear face, said display strips being rotatable together at the same time between a front facing position, in which said front faces cooperate with each other to produce an associated composite display figure that fully covers the display figure of said display plate, and a rear facing position, in which said rear faces cooperate with each other to produce an associated composite display figure that fully covers the display figure of said display plate, driving means for rotating all said display strips at the same time about their own vertical axes between said front facing position and said rear facing position, control means for temporarily keeping said display strips at each of said front facing position, said rear facing position, and a position substantially perpendicular to said rear and front facing positions where said front and rear faces are substantially perpendicular to said display plate, said driving means rotating said display strips in response to said control means so that the display figure of said display plate and the composite display figures to be produced by the front and rear faces of said display strips may be intermittently seen at predetermined time intervals through said transparent window panel, each of said display strips being rotatable into a position substantially parallel to said display plate, further comprising detecting means responsive to opening said front door for generating a detecting signal, said control means comprising means responsive to said detection signal when each of said display strips is free of said position substantially parallel to said display plate for operating said drive means to rotate each of said display strips until said display strips take such a parallel position, each of said display strips having a rearward edge, and means for suspending said display strips so that said display strips are rotatable about a vertical axis adjacent to said rearward edge and so that a lower end or each of said display strips is kept free from contacting respective floors of the sample rooms to enable a length of said strip to expand or contract in proportion to a change in temperature.

13. An automatic vending machine according to claim 12, wherein said driving means comprises a transversely elongated driving member with which a projection extending vertically from a forward end of the top of each display strip is freely rotatably connected;

a pair of linkage members freely connected with opposite ends of said transversely elongated driving member for allowing reciprocation in lengthwise directions of said transversely elongate driving member;

a swing arm connected with opposite ends of said driving member spaced away from said forward end and said opposite ends; and a drive motor connected with said swing arm through a reduction mechanism for rotating the display strips together about their own vertical axes selectively in clockwise and counter-clockwise directions.

14. An automatic vending machine according to claim 12, wherein said control means actuates movement of said display strips in response to a signal based on a selling operating of said automatic vending machine.

15. An automatic vending machine according to claim 12, wherein said control means comprises means for stopping movement of said display strips for a predetermined time period after an end of each cycle in which said display strips return from a starting position of their movement to a starting position.

16. An automatic vending machine according to claim 12, wherein said control means comprises means for stopping movement of said display strips for a predetermined time period after an end of each cycle in which said display strips move from a starting position of their movement to a position where they temporarily stop just before the starting position.

17. An automatic vending machine provided with a display apparatus, comprising, upper and lower sample rooms for exhibiting samples of articles of trade, the rooms being located on both sides, respectively, of a service panel which is attained to a front door of said vending machine, each sample room being covered by a transparent window panel which is fitted in said front door, upper and lower display-plates, each plate having a display figure formed thereon, said plates being located on the rear walls of said upper and lower sample rooms, respectively, an upper group of a plurality of vertically elongate display strips and a lower group of a plurality of vertically elongate display strips which are arranged side by side at desired intervals, respectively, and are located adjacent to said upper and lower display plates, respectively, each of said upper and lower groups of said display strips being rotatable about their own vertical axes, each of said display strips of each group having front and rear faces, said display strips of each group being rotatable together at the same time between a front facing position, in which said front faces of said display strips of each group cooperate with each other to produce an associated composite display figure which fully covers the display figure of each associated one of the upper and lower display plates, and a rear facing position, in which said rear faces of said display strips of each group cooperate with each other to produce an associated composite display figure which fully covers the display figure of each associated one of said upper and lower display plates, driving means for rotating said upper group of the display strips and said lower group of the display strips at the same time about their own vertical axes between said front facing position and said rear facing position, control means for controlling movement of each group of said display strips to temporarily keep said display strips of each group in said front facing position, said rear facing position, and a position substantially perpendicular to said front and rear facing position where said front and rear faces in each group are substantially perpendicular to said display plates respectively, said driving means rotating said display strips in response to said control means so that the display figure of said plate of each group and the composite display figures to be produced by the front and rear faces of said display strips of each group may be intermittently seen at predetermined time intervals through said transparent window panel, each of said display strips being rotatable into a position substantially parallel to said display plate, further comprising detecting means responsive to opening said front door for generating a detection signal, said control means comprising means responsive to said detection signal when each of said display strips is free of said position substantially parallel to said display plate for operating said drive means to rotate each of said display strips until said display strips take such a parallel position, each of said display strips having a rearward edge, and means for suspending said display strips so that said display strips are rotatable about a vertical axis adjacent to said rearward edge and so that a lower end of each of said display strips is kept free from contacting respective floors of the sample rooms to enable a length of said strip to expand or contract in proportion to a change in temperature.

18. An automatic vending machine according to claim 17, wherein said driving means comprising a transversely elongated driving member with which a projection extending vertically from a forward end of the tip of each display strip is freely rotatably connected;

a pair of linkage members freely connected with opposite ends of said transversely elongated driving member for allowing reciprocation in lengthwise directions of said transversely elongated driving member;

a swing arm connected with opposite ends of said driving member spaced away from said forward end and said opposite ends; and a drive motor connected with said swing arm through a reduction mechanism for rotating the display strips together about their own vertical axes selectively in clockwise and counter-clockwise directions.

19. An automatic vending machine according to claim 17, wherein said control means actuates movement of said display strips in response to a signal based on a selling operation of said automatic vending machine.

20. An automatic vending machine according to claim 17, wherein said control means comprises means for stopping movement of said display strips for a predetermined time period after an end of each cycle in which said display strips return from a starting position of their movement to a starting position.

21. An automatic vending machine according to claim 17, wherein said control means comprises means for stopping movement of said display strips for a predetermined time period after an end of each cycle in which said display strips move from a starting position of their movement to a position where they temporarily stop just before the starting position.

22. An automatic vending machine provided with a sample room for exhibiting samples of articles of trade and which is covered by a transparent window panel fitted in a front portion of the vending machine, comprising:

a display plate having a display figure formed thereon, said plate being located on a rear wall of said sample room, a plurality of vertical elongate display strips which are arranged side by side at desired intervals, said strips being located adjacent to said display plate and being rotatable about their own vertical axes so that when said display strips rotate together at the same time, either front faces or rear faces of said display strips may reach positions substantially parallel to said display plate, said faces including front faces and rear faces which cooperate with each other, respectively, to produce an associated composite display figure that fully covers the display figure of said display plate, driving means for rotating all of said display strips at the same time about their own vertical axes so that three kinds of display figures can successively be seen through said transparent window panel when said display strips are rotated to take three different angular positions, said three different angular positions including a first position at which the front and rear faces of said display strips are substantially perpendicular to said display plate so that the display figure of said display plate may be seen through spaces separating said display strips from each other, a second position at which the front faces of said display strips are substantially parallel to said display plate so that the composite display figure formed by said front faces may be directly seen, and a third position at which the rear faces of said display strips are substantially parallel to said display plate so that another composite display figure formed by said rear faces may be directly seen, means for emitting a selling signal in response to an input, mode selection means for selecting different modes which cause said driving means to effect movements at predetermined time intervals to enable the three kinds of display figures to be seen in succession, standby mode means responsive to an absence of said selling signal for causing selection of said modes via said mode selection means, and selling mode means responsive to a presence of said selling signal for causing selection of said modes via said mode selection means which is a different selection than that of said standby mode means.

23. A machine as in claim 22, wherein said driving means is responsive to said standby mode means for effecting said predetermined movements at predetermined time intervals in accordance with a group of said modes which constitutes said selection, said driving means being responsive to said selling mode means for effecting said predetermined movements at predetermined intervals in accordance with at most one of said modes of said groups of modes which constitute said different selection.

* * * * *